US008550933B2

(12) United States Patent
Demkowski et al.

(10) Patent No.: US 8,550,933 B2
(45) Date of Patent: Oct. 8, 2013

(54) SWING-WEIGHT-ADJUSTABLE GOLF CLUBS AND CLUBHEADS

(75) Inventors: Paul M. Demkowski, San Diego, CA (US); Bret H. Wahl, Escondido, CA (US); Peter L. Larsen, San Marcos, CA (US); Scott Edward Folck, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 170 days.

(21) Appl. No.: 13/194,846

(22) Filed: Jul. 29, 2011

(65) Prior Publication Data

US 2013/0029775 A1 Jan. 31, 2013

(51) Int. Cl.
*A63B 53/06* (2006.01)

(52) U.S. Cl.
USPC ..... 473/291; 473/337

(58) Field of Classification Search
USPC ..... 473/291
See application file for complete search history.

(56) References Cited

U.S. PATENT DOCUMENTS

| | | | |
|---|---|---|---|
| 1,133,129 | A | 3/1915 | Govan |
| 1,320,163 | A | 10/1919 | Maurice |
| 3,143,349 | A | 8/1964 | MacIntyre |
| 3,749,408 | A | 7/1973 | Mills |
| 3,814,437 | A | 6/1974 | Winquist |
| 4,326,326 | A | 4/1982 | MacDonald |
| 4,340,230 | A | 7/1982 | Churchward |
| 4,607,846 | A | 8/1986 | Perkins |
| 4,754,977 | A | 7/1988 | Sahm |
| 4,883,274 | A | 11/1989 | Hsien |
| 5,014,993 | A | 5/1991 | Antonious |
| 5,048,834 | A | 9/1991 | Gorman |
| 5,082,278 | A | 1/1992 | Hsien |
| 5,104,457 | A | 4/1992 | Viljoen et al. |
| 5,154,424 | A | 10/1992 | Lo |
| 5,242,167 | A | 9/1993 | Antonious |
| 5,244,210 | A | 9/1993 | Au |
| 5,385,348 | A | 1/1995 | Wargo |
| 5,395,113 | A | 3/1995 | Antonious |
| 5,571,053 | A | 11/1996 | Lane |
| 5,588,923 | A | 12/1996 | Schmidt et al. |
| 5,590,881 | A | 1/1997 | Jernigan |
| 5,658,208 | A | 8/1997 | Shimasaki |
| 5,658,209 | A | 8/1997 | Blakemore |

(Continued)

FOREIGN PATENT DOCUMENTS

| | | |
|---|---|---|
| JP | 02-084972 | 3/1990 |
| JP | 05-305162 | 11/1993 |

(Continued)

*Primary Examiner* — Michael Dennis
(74) *Attorney, Agent, or Firm* — Klarquist Sparkman, LLP

(57) ABSTRACT

Clubs and clubheads are disclosed that allow the swing-weight thereof to be easily changed by attaching or exchanging a "weight-assembly" having a first portion configured as a "weight insert," a second portion configured as an overcap, and a third portion configured as a drive screw. The drive screw extends through the overcap and into the weight-insert to assemble the weight-assembly, which fits into a weight-receiving cavity on the clubhead. These three components are made of respective materials (having respective densities) that are selected so that each component contributes a desired fraction of the total mass of the weight-assembly to the clubhead to achieve a desired change in swing-weight. By mix-match selection of the components, a wide range of masses of the weight assemblies can be made, with small increments therebetween.

3 Claims, 18 Drawing Sheets

(56) References Cited

U.S. PATENT DOCUMENTS

| | | | | |
|---|---|---|---|---|
| 5,776,010 | A | 7/1998 | Helmstetter et al. | |
| 5,795,245 | A | 8/1998 | Chang et al. | |
| 5,906,549 | A | 5/1999 | Kubica | |
| 6,015,354 | A | 1/2000 | Ahn et al. | |
| 6,027,415 | A * | 2/2000 | Takeda | 473/291 |
| 6,162,133 | A | 12/2000 | Peterson | |
| 6,206,790 | B1 | 3/2001 | Kubica et al. | |
| 6,290,609 | B1 | 9/2001 | Takeda | |
| 6,409,612 | B1 | 6/2002 | Evans et al. | |
| 6,648,772 | B2 | 11/2003 | Vincent et al. | |
| 6,811,496 | B2 | 11/2004 | Wahl et al. | |
| 6,890,267 | B2 | 5/2005 | Mahaffey et al. | |
| 6,988,960 | B2 | 1/2006 | Mahaffey et al. | |
| 7,121,956 | B2 | 10/2006 | Lo | |
| 7,244,188 | B2 | 7/2007 | Best | |
| 7,351,164 | B2 | 4/2008 | Schweigert et al. | |
| 7,390,270 | B2 | 6/2008 | Roberts et al. | |
| 7,507,167 | B2 | 3/2009 | Roach et al. | |
| 7,575,523 | B2 | 8/2009 | Yokota | |
| 7,588,502 | B2 | 9/2009 | Nishino | |
| 7,871,339 | B2 | 1/2011 | Sanchez et al. | |
| 2003/0013545 | A1 | 1/2003 | Vincent et al. | |
| 2007/0105655 | A1 * | 5/2007 | Beach et al. | 473/336 |
| 2009/0286611 | A1 * | 11/2009 | Beach et al. | 473/246 |

FOREIGN PATENT DOCUMENTS

| | | |
|---|---|---|
| JP | 10-277187 | 10/1998 |
| JP | 11-244433 | 9/1999 |
| JP | 2001-149514 | 6/2001 |
| JP | 2001-321474 | 11/2001 |
| JP | 2003-047678 | 2/2003 |
| JP | 2003-169870 | 6/2003 |
| JP | 2004-041681 | 2/2004 |

* cited by examiner

SWING-WEIGHT-ADJUSTABLE GOLF CLUBS AND CLUBHEADS

FIELD

This disclosure pertains to, inter alia, golf clubs and clubheads for same. More specifically, this disclosure pertains to clubs and clubheads that include attachable weights used for adjusting the swing-weight of same.

BACKGROUND

Over its long history, the game of golf has progressively evolved. This evolution has been especially pronounced in the equipment used to play golf. With the development of modern golf clubs, a number of variables and factors have been identified and refined to allow sets of clubs to be tailored for the respective golfers who use them. For example, some aspects of a club's "feel" as used during play have been identified and quantified sufficiently to allow those aspects to be controlled and even adjusted, either during manufacture of the club, at point of sale, or even later after the club has been used for actual play. Examples of these aspects of feel include size, shape, mass, and material of the clubhead, distribution of mass in the clubhead and shaft, clubhead material, shaft material, geometry and composition of the strike face, center of gravity and coefficient of restitution of the clubhead, etc.

Another factor is "swing-weight," which is a measure of how the mass of the club feels as the club is being swung for hitting a golf ball. Generally, swing-weight reflects how mass is distributed in the club, as reflected by the club's perceived resistance to being moved during a "swing." More specifically, the swing-weight is a measurement of a golf club's mass about a pivot point established at a specified distance from the grip-end of the club. Even more specifically, the swing-weight of a club is a measure of the club's moment of inertia about a point located 14 inches from the grip-end. Swing-weight can also be regarded as a measurement of a club's "balance," i.e., the degree to which the club's mass balances toward the clubhead. A first club having a balance point located nearer the clubhead than a second club will generally feel heavier when swung than will the second club. Thus, key factors of swing-weight are shaft length and clubhead mass, with lesser contributions being made by other components and configurational details of the club.

Golfers have been at least subjectively aware of swing-weight for a long time, and many realize the importance of correlating the club's swing-weight to the natural speed at which a particular golfer can swing the club. Substantial mis-correlation in this regard can result in poor golfing performance. Golfers having a relaxed swing tend to do better with clubs having a heavier swing-weight. Golfers having a rapid swing, on the other hand, tend to do better with clubs having less swing-weight. Coordinating swing-weight to a golfer's swing allows the club to rotate around the pivot point of the golfer's body as rapidly as the golfer's body is being rotating while executing the swing.

The swing-weight scale was developed empirically in the 1920's. It currently has seven major indices: A, B, C, D, E, F, and G. Between each of these major indices are ten divisions (minor indices). Hence, a portion of the scale would be $A_{0\,1\,2\,3\,4\,5\,6\,7\,8\,9}B_{0\,1\,2\,3\,4\,5\,6\,7\,8\,9}C\ldots$ (The actual numbers are not subscripts; but, they are so written here for clarity.) The G index includes the numeral 10, yielding a total of 73 "points." Each swing-weight point is a respective combination of a major index and a minor index, and each point has a respective numerical value, depending upon the club. For example, golf clubs used by men usually have a swing-weight in the range of D0 to D5, whereas a woman's golf club may have a swing-weight of C5 to C7, wherein C denotes a lower swing-weight than D, and D3 denotes a greater swing-weight than D2. Swing-weights are usually tabulated for each of various values of shaft mass. Each table lists successive club lengths and corresponding swing-weight values based on clubhead mass.

The swing-weight scale was conceived at a time when golf-club shafts were usually made of wood, which is generally less flexible than many modern shaft materials. As a result, the swing-weight scale was developed under the assumption that the club's moment of inertia was usually about 14 inches from the grip-end of the shaft. Nowadays, shafts made of non-wood materials are usually more flexible than wooden shafts, and with most golfers these clubs tend to rotate during a swing about a point located closer than 14 inches from the butt-end. Nevertheless, the swing-weight scale based upon a 14-inch fulcrum has survived and is still used. Swing-weight is usually determined using a measurement device.

Swing-weight can be very sensitive to dimensional variations in a population of otherwise similar golf clubs. For example, during manufacture of a golf club, dimensions, material specifications, processes, configurational details, and the like of each component of the club normally have respective tolerances. Shaft lengths also exhibit a length tolerance even if they all have nominally the same length. During a production run in which a lot of clubs having a particular design are manufactured, tolerance stack-up naturally results in the clubs having respective swing-weights that vary slightly from one club to the next in the lot, for example from D0 to D5. Swing-weight is also affected by tolerances or changes in the grip. For example, increasing the size of the grip generally reduces the swing-weight of a club.

Swing-weight does not necessarily correlate with club mass. Stiffer shafts tend to have "lighter" feel, and more flexible shafts tend to have "heavier" feel. For example, graphite shafts have less mass but are more flexible than metal shafts. Changing a shaft from metal to graphite, for example, generally reduces the mass of the club while generally increasing its swing-weight.

Changing the "balance" of a club, and hence the club's swing-weight, is conventionally achieved by changing the location of a unit of discretionary mass on the club and/or by changing the actual mass of the unit. For example, consider three otherwise identical clubs in which only the location of the unit of discretionary mass is changed from one club to the next. The magnitude of heaviness "feel" of a club will vary depending upon the location of the unit of discretionary mass, even though all have exactly the same total mass. This change is particularly evident if the first club has the unit of mass located on the clubhead, the second club has the unit of mass located on the shaft, and the third club has the unit of mass located on the grip. The third club will have a lower swing-weight, and thus feel lighter when swung, than either the first club or the second club.

Swing-weight is often an issue at the time of sale of a set of clubs, particularly for experienced golfers. Not only is the ideal swing-weight for the golfer usually determined at this time, but also it is desirable that substantially all the clubs in the set have the same or closely similar swing-weight so that the golfer need not change his swing each time he uses a different club from the set.

A conventional hosel-plug scheme is shown in FIG. 1, depicting an iron-type clubhead 10. The clubhead 10 includes a sole 12, a heel 14, a toe 16, and a hosel 18. Also shown is a plug 20 that is inserted into the hosel 18 for changing the swing-weight of the club. The plugs 20 are made of various materials to provide similarly sized plugs having different respective weights that can be individually selected. In FIG. 1, as mass is added to or removed from the hosel 18 (e.g., adding a heavier plug, adding a lighter plug, or removing the plug), the mass properties of the clubhead (more specifically the position of the clubhead's center of gravity (CG)) typically change. Example data are listed in Table 1, below, for two otherwise similar irons having different hosel configurations A and B:

TABLE 1

| Club Head | Nom CGX | 5 g CGX | 10 g CGX* | Tot. CGX* | Nom. Zup | 5 g Zup | 10 g Zup* | Tot. Zup* |
|---|---|---|---|---|---|---|---|---|
| A | 1.7 | 2.6 | 3.5 | 1.8 | 19.6 | 19.8 | 20.1 | 0.5 |
| B | 3.3 | 4.1 | 4.9 | 1.6 | 19.2 | 19.4 | 19.5 | 0.3 |

wherein "Nom." means nominal (no added weight), * indicates data obtained for the club including the 10-gram hosel weight, "Tot." is the 10-g data less the corresponding nominal data, CGX refers to center-of-gravity (CG) position (mm) along the heel-to-toe axis (X-axis), and Zup refers to CG position (mm) along the Z-axis (vertical axis). Thus, by inserting a 10-g plug 20 into the hosel 18, the CG of the clubhead 10 shifts in position along the X-axis exactly 1.8 mm toward the hosel 18 and exactly 0.5 mm in the vertical direction (Z-direction). This positional shifting of the CG can have a substantial effect on the performance of the club during play, influencing not only its left-right distribution of mass but also the trajectory of a ball struck by the club.

Beyond the influence of ball flight, alteration of CG location can also influence the feel of a golf club, such as an iron. Striking a ball on the strike face at a location displaced from the CG has an adverse effect on the feel generated by that shot. In contrast, strikes occurring at the CG produce quieter, purer sounds than off-center strikes. Better players will attest to this and often find the CG of their clubs changed over time through use. This can be seen in many instances by examination of the round wear pattern on a club face of a well-used iron. On the clubs of a highly skilled player, the round pattern is usually slightly toward the heel of the clubhead and is in approximate alignment with the position of the CG. Hence, it is desirable to preserve the location of the CG of a clubhead even as other changes are made to the club.

Another conventional manner of changing swing-weight involves inserting a longitudinally extended insert into the shaft near the tip-end. Unfortunately the insert, usually called a "nail," is prone to rattling or other vibration inside the shaft during use of the club, especially whenever the club is used in play. The nail can be made of any of various materials to provide different respective masses, typically aluminum, brass, and steel.

Yet another conventional manner of changing swing-weight is discussed in U.S. Pat. No. 7,871,339 to Sanchez. A balance weight is selected from multiple balance weights and mounted in a weight cavity formed in the clubhead. The balance weight is then covered with a "badge" cover that is bonded to the clubhead. One difficulty with this system is that the badge, after being bonded to the weight cavity, ordinarily cannot be removed without damaging or destroying at least the badge and clubhead.

SUMMARY

A first aspect of the invention is directed to golf clubs, of which an exemplary embodiment comprises a clubhead, a shaft, and a weight-assembly. The clubhead comprises a body having a front and a rear. The front includes a strike face, the rear includes a weight-receiving cavity, and the body has a center of gravity (CG) having respective X-, Y-, and Z-coordinates. The shaft is connected to the clubhead, thereby forming the golf club having a nominal swing-weight. The weight-assembly is removably attached as a unit to the weight-receiving cavity. The weight-assembly has a corresponding assembled total mass providing a corresponding swing-weight (SW) contribution to the club. The weight-assembly comprises at least a first portion, a second portion, and a third portion each contributing a respective mass portion to the assembled total mass of the weight-assembly and thus to the SW contribution made by the weight-assembly to the club. The total mass of the weight-assembly linearly displaces the CG location no more than 1.7 mm with the weight-assembly attached to the body compared to a CG location of the clubhead when the weight-assembly is not attached to the body. This is a key advantage because it allows the swing-weight of a club to be changed as required without causing a significant collateral change in the position of the center of gravity in the X-Z plane.

In many embodiments, the first and third portions of the weight assembly are configured to be freely rotatable with respect to the second portion. The second portion of the weight-assembly contacts the body as the first portion is received in the weight-receiving cavity.

Upon attachment of the weight-assembly to the clubhead by receiving the first portion thereof in the weight-receiving cavity, a gap desirably is present between the bottom surface of the first portion and a bottom wall of the weight-receiving cavity. This configuration provide a maximum engagement force of the weight-assembly to the clubhead, which ensures that the weight-assembly remains attached to the clubhead during normal use of the club.

The third portion of the weight assembly desirably is engaged with the first portion by a mechanical connection, such as (but not limited to) a threaded connection. Also, the first portion of the weight-assembly desirably is engaged with the body by a threaded connection. These threaded engagements facilitate secure attachment and easy removal of the weight-assembly when desired. If required, a thread-locking material can be located between the body of the clubhead and the first portion of the weight-assembly.

By way of example, in certain embodiments the third portion of the weight-assembly is a drive-screw. A drive-screw can be provided with a drive feature that is engageable with a corresponding tool to turn the drive-screw for assembling and disassembling the weight-assembly, for attaching the weight-assembly to the weight-receiving cavity, and for detaching the weight-assembly from the weight-receiving cavity.

The first, second, and third portions have respective volumes and respective densities so that each of the first, second, and third portions contributes a respective predetermined mass portion to the total mass of the weight-assembly for swing-weighting of the golf club. The respective densities of the first, second, and third portions can be different from each other.

In an advantageous embodiment of the golf club, the third portion of the weight-assembly extends through the second portion and is coupled to the first portion. With such a configuration, respective manipulations of the third portion remove the weight-assembly from and attach the weight-assembly to the weight-receiving cavity. For example, and not intending to be limiting, the third portion of the weight-assembly can be a drive-screw that threads into the first portion. In some embodiments, as the first portion threads into the weight-receiving cavity, the second portion of the weight-assembly comprises a non-circular overcap that is held to the first portion by the third portion whenever the first portion is threaded into the weight-receiving cavity.

In certain embodiments the first portion of the weight-assembly is a weight-insert, while the second portion is an overcap that extends over and conceals the weight-insert whenever the weight-assembly is attached to the weight-receiving cavity. In these and other embodiments, the weight-insert and drive-screw freely rotate relative to the overcap.

The weight-insert can define a cutout having a defined volume that subtracts a respective portion of mass from the weight-insert compared to an otherwise similar weight-insert lacking the cutout. Thus, weight inserts can be provided that have a large selection of available respective masses.

With respect to the weight-assembly, the first portion desirably is more massive than the second portion, while the second portion desirably is more massive than the third portion. In certain of these configurations the CG of the first portion of the weight-assembly can be situated closer to the CG of the clubhead than the CG of either the second or third portions whenever the weight-assembly is attached to the clubhead.

The weight-assembly desirably has a total mass in the range of up to at least 10 g. Desirably, the total mass of the weight assembly linearly displaces the CG location of the clubhead no more than 1.0 mm with the weight-assembly attached to the body, compared to a CG location of the clubhead when the weight-assembly is not attached to the body.

The CG of a clubhead to which a weight-assembly has not been attached can be regarded as having an X-coordinate, a Y-coordinate, and a Z-coordinate. The weight-assembly as attached to the clubhead can thus have substantially the same Y-coordinate as the CG of the clubhead.

In certain embodiments of the golf club the first portion is a weight-insert fabricated of a material selected from the group consisting of stainless steel, aluminum alloy, titanium alloy, and tungsten alloy. The second portion desirably is an overcap fabricated of a material selected from the group consisting of stainless steel, aluminum alloy, titanium alloy, and tungsten alloy. The third portion desirably is a drive-screw fabricated of a material selected from the group consisting of stainless steel and titanium alloy.

Another aspect of the invention is directed to golf-club kits, of which an exemplary embodiment comprises at least one golf club and a plurality of weight-assemblies. Each golf club in the kit comprising a shaft and a clubhead connected to the shaft. Each clubhead has a body of which the center of gravity (CG) is located at respective X-, Y-, and Z-coordinates, and each clubhead has a front and a rear. Each club has a respective nominal swing-weight and comprises a weight-receiving cavity extending into the body from the rear. The weight-assemblies in the kit each have substantially identical size but have different respective total mass. The weight-assemblies are selectable for individual attachment to a weight-receiving cavity of a clubhead so as to provide the respective club with a corresponding selected swing-weight. Each weight-assembly comprises a first, a second, and a third portion each contributing a respective mass portion to the respective total mass of the weight-assembly for swing-weighting the club. In each weight-assembly in the kit, the third portion extends through the respective second portion and is coupled to the respective first portion, and the first portion of the selected weight-assembly is attachable in the weight-receiving cavity. The respective mass portions of the first, second, and third portions are determined by the volume and density of respective materials from which the first, second, and third portions are made.

The weight-assemblies in the kit include a series of selectable weight-assemblies having corresponding assembled total masses that progressively differ from one another in the series by a designated mass increment. With respect to the series, the designated mass increment desirably is 0.5 grams or less. Also, the respective mass portions of at least one of the first, second, and third portions of the weight-assemblies can be non-linear when plotted in order of succession in the series. Further with respect to the series in certain embodiments, whereas the designated mass increment desirably is 0.5 grams or less, the respective mass portions of each of the first, second, and third portions of the weight-assemblies can be non-linear when plotted in order of succession in the series.

According to yet another aspect of the invention, golf-club sets are provided, of which an exemplary embodiment comprises a plurality of iron-type clubheads including at least a first iron-type clubhead and a second iron-type clubhead. Also included in the set are first and second weight-assemblies. The first weight-assembly, attached to the first iron-type clubhead, includes a respective first portion, a respective second portion, and a respective third portion. The second weight-assembly, attached to the second iron-type clubhead, includes a respective first portion, a respective second portion, and a respective third portion. At least one of the first portion, second portion, and third portion of the first weight-assembly varies in density with respect to the first portion, second portion, and third portion of the second weight-assembly.

In certain embodiments of the golf-club set, the first linear CG shift distance after the first weight-assembly is attached to the first iron-type clubhead desirably is no more than 1.5 mm. Similarly, the second linear CG shift distance after the second weight-assembly is attached to the second iron-type clubhead desirably is no more than 1.5 mm. Further, the second portion of the first weight-assembly and the second portion of the second weight-assembly desirably have substantially similar size and shape.

The various embodiments described herein provide multiple advantages. For example, mass can be added to a clubhead at final assembly to ensure a tight swing-weight tolerance for each club made on the assembly line. Also, the embodiments produce minimal CG shift accompanying a change in swing-weight. The embodiments also allow every club in a set (at least every iron) to be customized to a particular swing-weight, which can be accurately and precisely equal throughout the set.

Weight-assemblies in a kit thereof can provide a large range of masses that can be attached to a club to compensate for variations in players, conditions, and other factors. Each mass in the range can be different from adjacent masses by a preset amount, such as 0.5 g increments. Providing selectable masses at this resolution is achieved by, inter alia, making the components of the weight-assemblies of different materials having different respective densities, as well as by controlled variations in cutout depth.

The weight-assemblies are easily mounted on a clubhead and also easily removed without causing any destruction or damage to either the weight-assembly or to the club.

The foregoing and additional features and advantages of the subject methods will be more readily apparent from the following detailed description, which proceeds with reference to the accompanying drawings.

DETAILED DESCRIPTION

Figure 1:
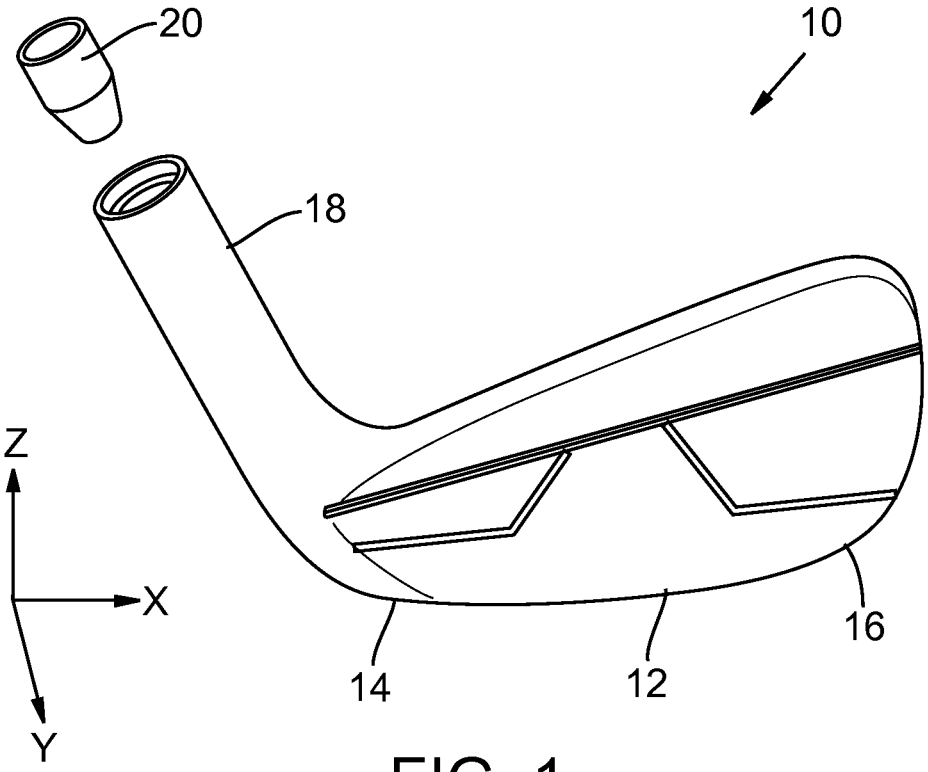
FIG. 1 (Prior Art)
FIG. 1 is a perspective view of a conventional iron-type clubhead configured to receive a hosel weight for providing the clubhead with a particular swing-weight.

This disclosure is set forth in the context of representative embodiments that are not intended to be limiting in any way.

The drawings are intended to illustrate the general manner of construction and are not necessarily to scale. In the detailed description and in the drawings themselves, specific illustrative examples are shown and described herein in detail. It will be understood, however, that the drawings and the detailed description are not intended to limit the invention to the particular forms disclosed, but are merely illustrative and intended to teach one of ordinary skill how to make and/or use the invention claimed herein.

As used in this application and in the claims, the singular forms "a," "an," and "the" include the plural forms unless the context clearly dictates otherwise. Additionally, the term "includes" means "comprises." Further, the term "coupled" encompasses mechanical as well as other practical ways of coupling or linking items together, and does not exclude the presence of intermediate elements between the coupled items.

The described things and methods described herein should not be construed as being limiting in any way. Instead, this disclosure is directed toward all novel and non-obvious features and aspects of the various disclosed embodiments, alone and in various combinations and sub-combinations with one another. The disclosed things and methods are not limited to any specific aspect or feature or combinations thereof, nor do the disclosed things and methods require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed things and methods can be used in conjunction with other things and method. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In the following description, certain terms may be used such as "up," "down,", "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Figure 13:
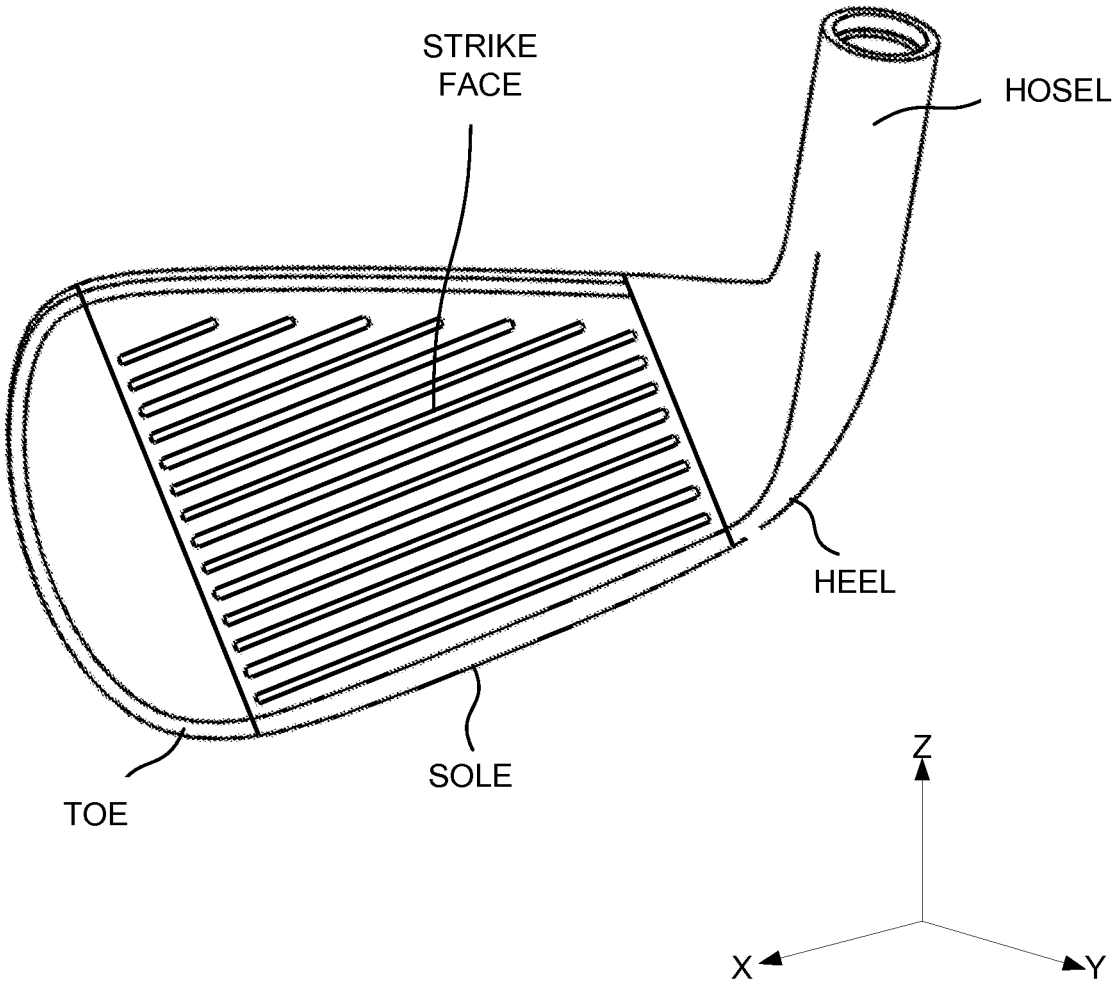
PRIOR ART FIG. 13
FIG. 13, as an oblique view, depicts axes and basic features of a conventional iron-type clubhead.

Golf clubs and clubheads are usually described in the context of a Cartesian coordinate system, in which the X-axis extends from the heel to the toe of the clubhead, the Y-axis extends from front to rear, and the Z-axis is a vertical axis normal to the X- and Y-axes. See FIG. 13. The X-axis and the Y-axis are parallel to a perfectly flat ground plane, and the Z-axis is perpendicular to the X-axis and the Y-axis. CG movement can be defined with respect to a distance between two CG points that are projected onto an X-Z plane or, alternatively, can be described as an absolute linear distance between two CG points within three-dimensional (X-Y-Z) space.

Figure 2A:
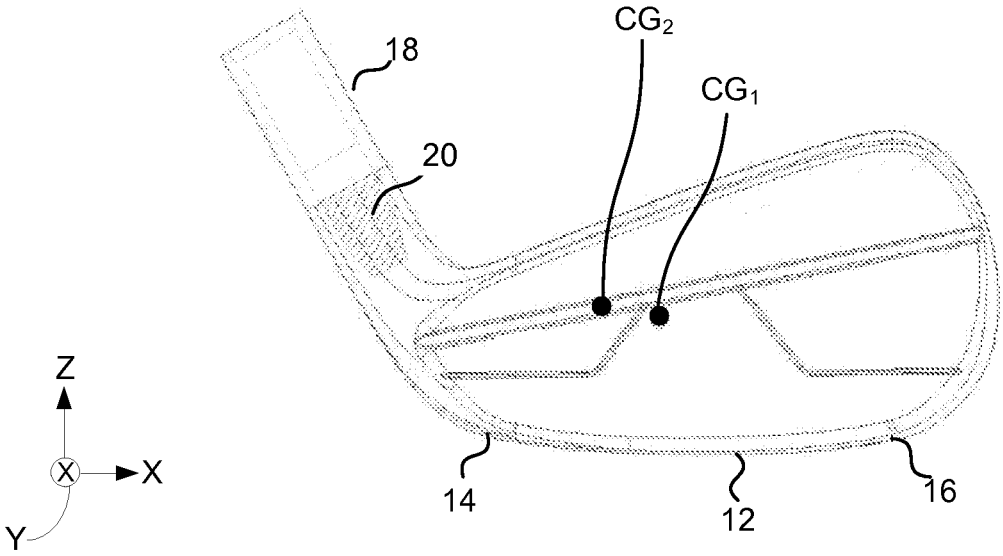
FIG. 2A is an elevational view of the clubhead of FIG. 1, particularly showing a substantial shift of the center of gravity (CG) accompanying attachment of a ten-gram hosel weight to the clubhead.
Figure 2B:
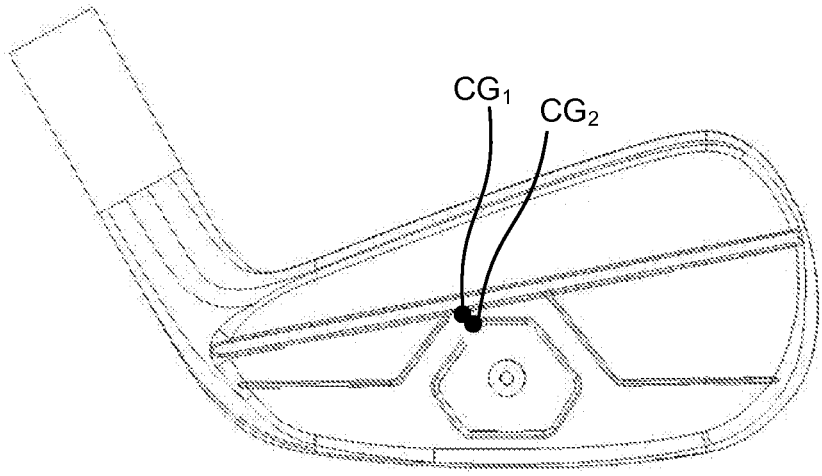
FIG. 2B is an elevational view of an embodiment of an iron-type clubhead as disclosed herein, in which attachment of a weight-assembly to change the swing-weight does not result in a significant shift of CG of the clubhead.

The systems and methods disclosed herein include adding weight to or removing weight from a clubhead of a golf club, particularly for making a corresponding change in swing-weight of the club, without significantly altering the location of the center of gravity (CG) of the clubhead and without having to disassemble, detach, damage, or destroy the clubhead or shaft. Consequently, the CG position remains substantially constant across the range of weights that can be selected. This is illustrated by comparing FIGS. 2A and 2B. In FIG. 2A the rear surface of a conventional iron is shown. Also shown is the first CG position ($CG_1$) as viewed from the rear of the clubhead when the clubhead is in an address position. According to conventional practice, a 10-gram weight ("hosel plug") has been added near the tip-end of the shaft inside the hosel to change the swing-weight of the club. This caused a substantial lateral shift (greater than 1.8 mm) of the CG of the clubhead ($CG_2$; compare its position with that of $CG_1$). The rear surface of an otherwise similar iron-type clubhead, on which a swing-weight-adjustment weight has been attached as disclosed herein, is shown in FIG. 2B. In FIG. 2B the nominal CG before adding the weight is denoted by $CG_1$. The marker $CG_2$ denotes the CG after attaching a 10-gram weight to adjust the swing-weight of the club. In one embodiment, the CG location is actually shifted to be closer to the center of the strike face after the weight is inserted. Note the very slight shift of the CG accompanying attachment of the weight, which equates to an insignificant change in CG position. In some embodiments, the CG location of the clubhead after the weight is inserted, compared to the clubhead CG before the weight is inserted, is less than 1.5 mm away (measured linearly between CG locations in the X-Z-Y coordinate system), or less than 1 mm, or less than 0.7 mm, or less than 0.5 mm, or less than 0.3 mm, or even less than 0.2 mm away.

First Representative Embodiment

Figure 3A:
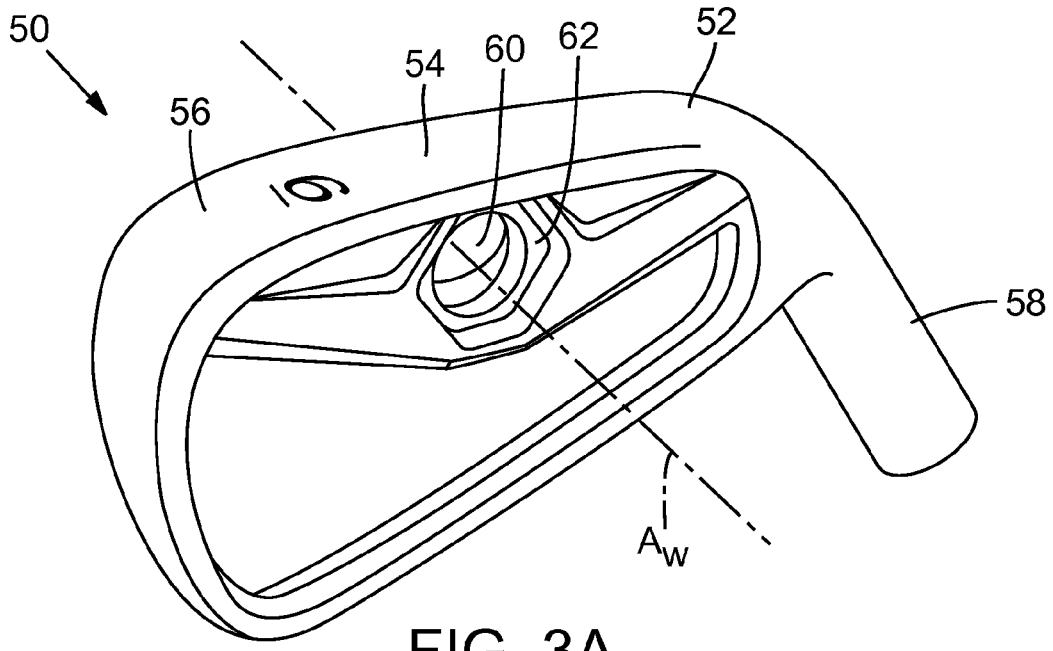
FIG. 3A is an oblique view of a cavity-back iron-type clubhead according to the first representative embodiment; this view depicts the weight-mounting aperture and cap-recess that receive a weight-assembly.

This embodiment is directed to a "cavity back" iron-type clubhead and golf club including a weight-assembly providing the clubhead and club with a desired swing-weight. A general oblique view of the clubhead 50 is shown in FIG. 3A, in which the heel 52, sole 54, toe 56, and hosel 58 are visible. Also visible are a weight-mounting aperture 60 and a cap-recess 62 by which a weight-assembly (not shown) for providing the desired mass adjustment is attachable to the clubhead 50 from behind. The clubhead 50 excluding the hosel 58 thereof is termed the "body."

The weight-mounting aperture 60 is an exemplary configuration of a weight-receiving cavity in general. A "weight-receiving cavity" is a cavity or space, defined by the body of the clubhead 50, configured to receive at least a portion of a weight such as a "weight-assembly" (discussed later below) that is attachable to the clubhead and thus used for altering the swing-weight of the club. Desirably, the weight-receiving cavity has a central axis $A_w$ that receives a weight member having a coinciding (when attached to the clubhead) weight central axis. The weight further includes a center-of-mass point. In one embodiment, when the center-of-mass point is projected in an X-Z plane, the projected center-of-mass point of the weight is in a substantially similar location compared to the CG location within the X-Z plane. In certain embodiments, the cavity's central axis $A_w$ coincides with or is substantially parallel to the Y-axis or is or slightly offset from the Y-axis by an angle equal to the loft of the clubhead. Consequently, whenever the weight-assembly is inserted into and secured in the weight-receiving cavity, the corresponding added mass is centered on the $A_w$ axis and does not cause any substantial shift of the X- and Z-coordinates of the CG. Depending upon the particular configuration of the clubhead, the weight-receiving cavity may be a blind hole or through-hole, for example. In this embodiment, the weight-mounting aperture has a female thread to facilitate attachment of the weight-assembly to the clubhead 50.

The clubhead 50 can be made of any rigid material having properties suitable for iron-type clubheads. For example, and not intending to be limiting in any way, the clubhead can be made of steel, titanium array, or of stainless steel. Forging is an economical manner of fabricating the clubhead.

Figure 3B:
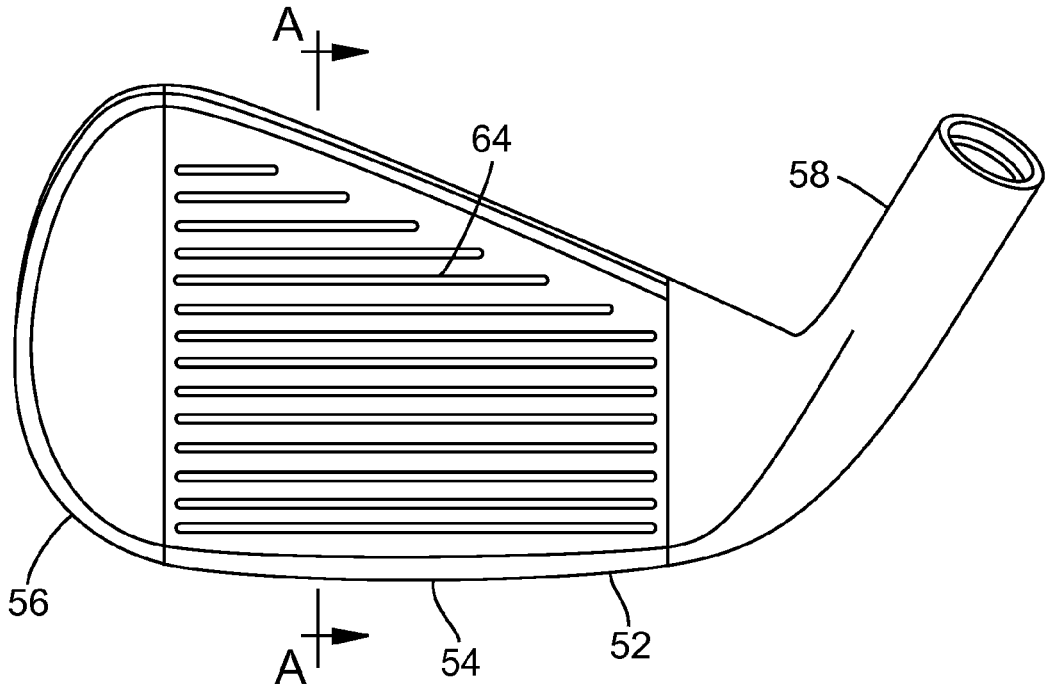
FIG. 3B is a front elevational view of the clubhead of FIG. 3A, showing the strike face and hosel.
Figure 3C:
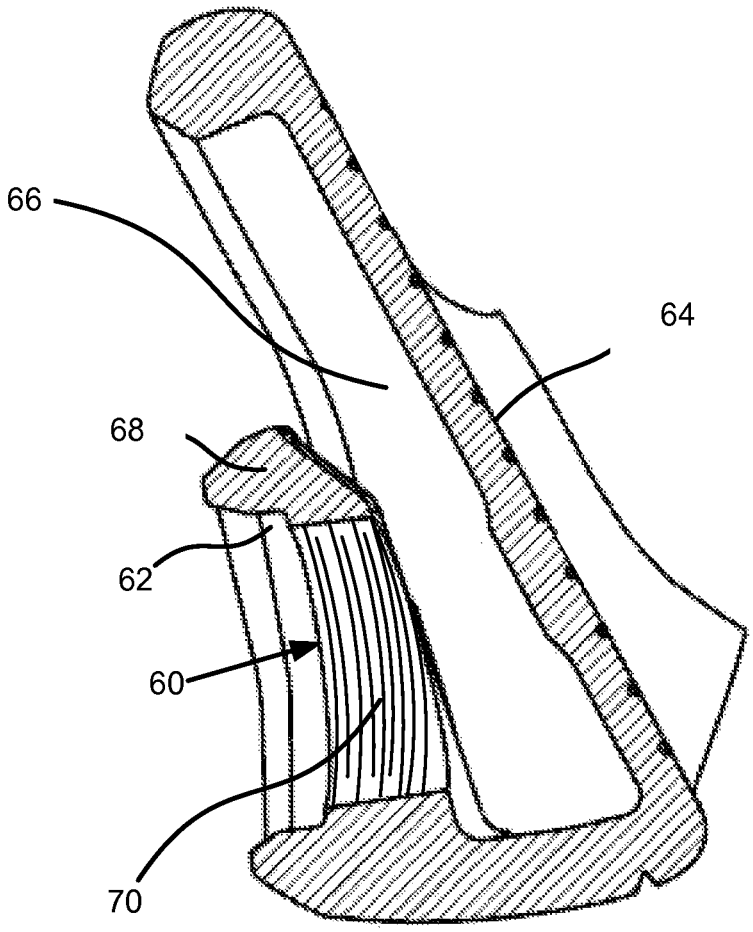
FIG. 3C is a section along the line A-A in FIG. 3B, depicting the strike face, a cavity located behind the strike face, the weight-mounting aperture, and the cap-recess.

The front of the clubhead 50 is shown in FIG. 3B, depicting the strike face 64 and hosel 58. FIG. 3C is a section along the line A-A in FIG. 3B, depicting the strike face 64, a void 66 located behind the strike face, the weight-mounting aperture 60, and the cap-recess 62. In this embodiment, the weight-mounting aperture 60 extends through a portion 68 of the clubhead that is situated rearwardly of the strike face 64. As noted above, the weight-mounting aperture 60 is female-threaded. By way of example and not intended to be limiting, the weight-mounting aperture 60 has, by way of example, an M14×1.0 female thread 70 configured to receive a corresponding male thread of a weight-insert of a "weight-assembly" (see below) used for changing the nominal swing-weight of the finally assembled golf club (including clubhead, shaft, and grip) to achieve a predetermined swing-weight of the golf club that includes the clubhead. It is understood that threaded portions described herein can be replaced with any mechanical connection such as, but not limited to, keying, welding, hole-and-pin connections, and press-fit.

Figure 4A:
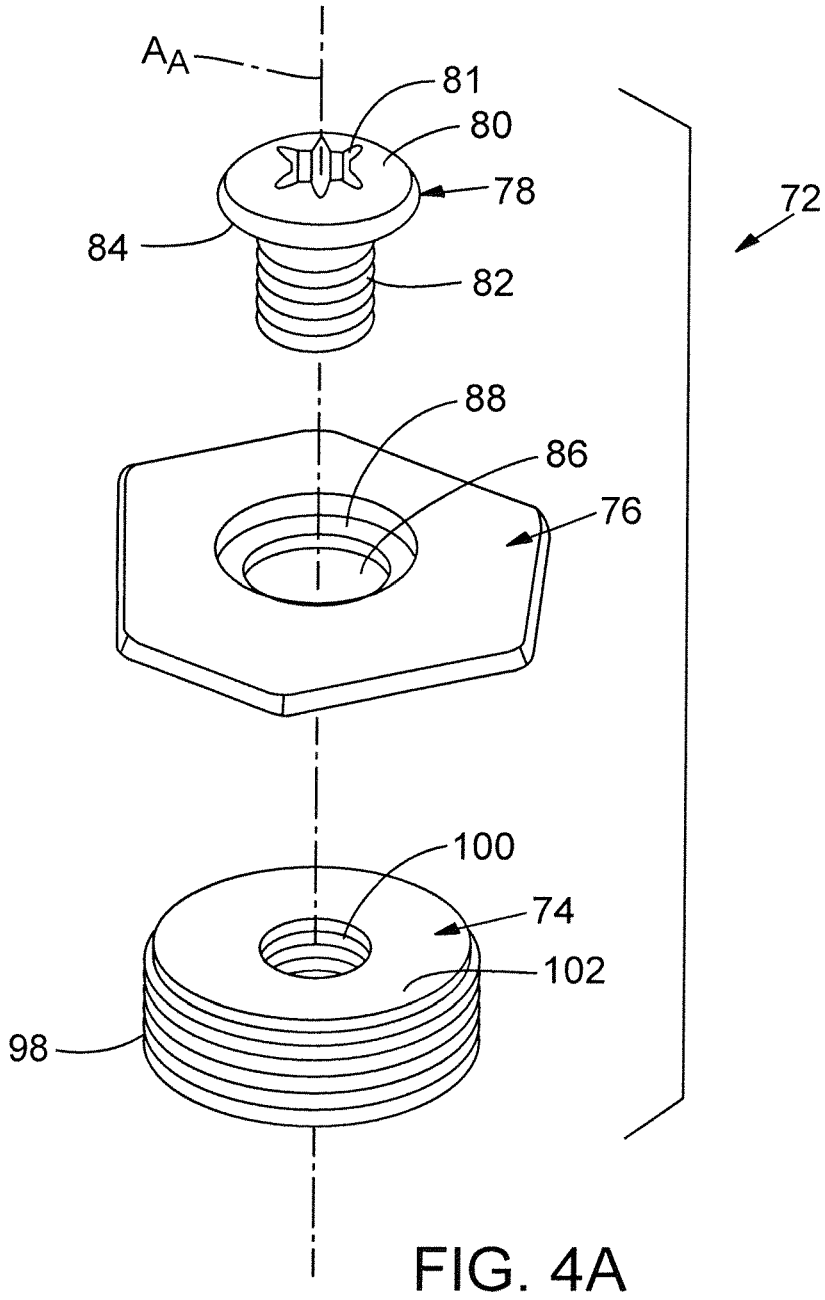
FIG. 4A is an oblique exploded view of an embodiment of a weight-assembly as usable in any of the various embodiments.
Figure 4B:
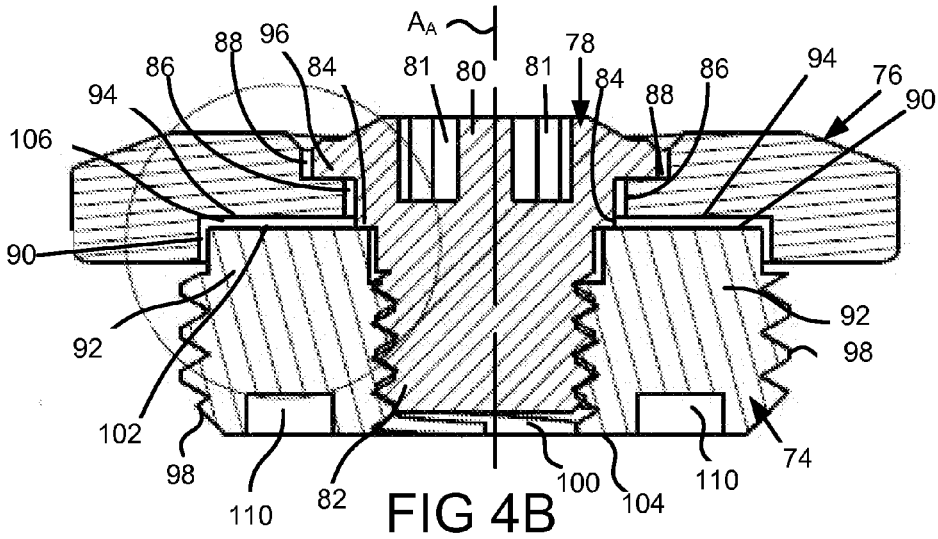
FIG. 4B is an elevational section of an assembled weight-assembly of FIG. 4A.
Figure 4C:
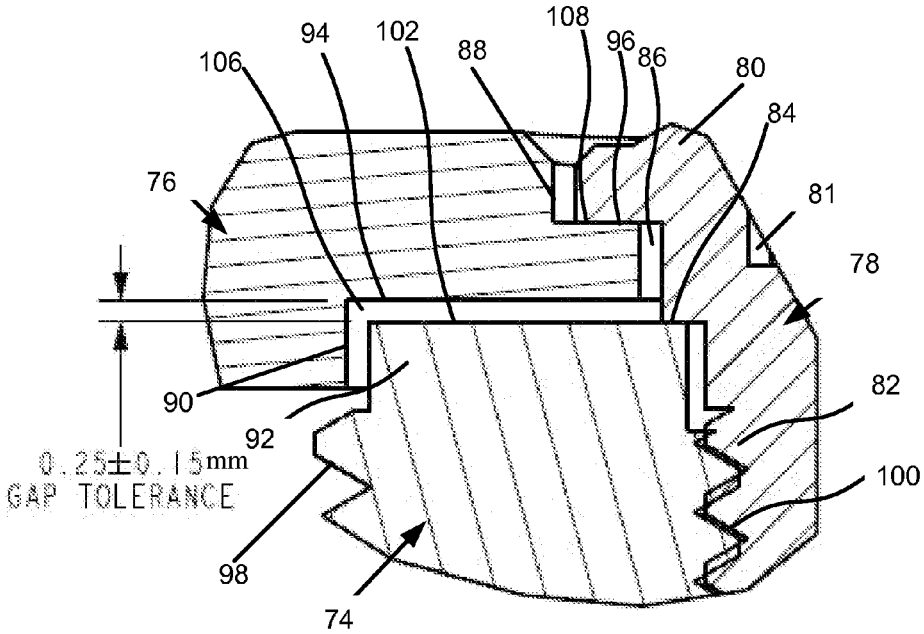
FIG. 4C is an enlargement of the region of FIG. 4B located in the circle.

An embodiment of a weight-assembly 72 for use with the clubhead 50 shown in FIGS. 3A-3C is generally shown in FIGS. 4A-4C. Referring to FIG. 4A, the weight-assembly 72 is an integral unit that comprises a weight-insert 74, an overcap 76, and a drive-screw 78. The drive-screw 78 comprises a head 80 including a drive feature 81. The drive-screw also comprises a male-threaded portion 82 and a shoulder 84. The overcap 76 defines an aperture 86 through which the male-threaded portion 82 of the drive-screw 78 extends. The overcap 76 also includes a first counterbore 88 configured to receive the head 80 of the drive-screw 78 and a second counterbore 90 configured to receive the upper portion 92 of the weight-insert 74 (see FIG. 4B). The first counterbore 88 defines a first shoulder 96, and the second counterbore 90 defines a second shoulder 94 (FIG. 4C). The weight-insert 74 includes an outer male thread 98 and a female-threaded aperture 100, the latter receiving the male-threaded portion 82 of the drive-screw 78. As noted above, the outer male thread 98 of the weight-insert 74 is a feature by which the weight-insert is received in the weight-mounting aperture 60 on the clubhead. The weight-insert 74 also includes an upper main surface 102 and a lower main surface 104.

The weight-assembly 72 is assembled together as a unit as shown in FIG. 4B. In the finished assembly, the drive-screw 78 extends through the aperture 86 in the overcap 76 and into the female-threaded aperture 100 in the weight-insert 74 as the head 80 of the drive-screw 78 fits into the first counterbore 88 of the overcap 76 and the upper portion 92 of the weight-insert 74 fits into the second counterbore 90. To ensure that the drive-screw 78 is and remains bonded to the weight-insert 74, a thread-locking compound or adhesive may be added to the male threads 82 of the drive-screw and/or the threaded aperture 100 before inserting the drive-screw into the aperture. In a finished weight-assembly 72, the drive-screw 78 is fully tightened in the threaded aperture 100, thereby forming an integral unit. In the assembly, as a result of the relative configurations of the head 80 of the drive-screw 78 and the counterbores 88, 90 in the overcap 76, the overcap can still rotate relative to the weight-insert 74 and drive-screw 78. This is shown in FIGS. 4B and 4C. Referring first to FIG. 4B, a drive-screw 78 fully inserted into the threaded aperture 100 of the weight-insert 74 becomes "tightly" inserted when the shoulder 84 (see also FIG. 5A) of the drive-screw engages the upper main surface 102 of the weight-insert 74. When the drive-screw 78 is so tightened, it and the upper main surface 102 of the weight-insert 74 define a gap 106 that loosely accommodates the first and second shoulders 96, 94 on the overcap. More specifically, the gap 106 is situated between the upper main surface 102 of the weight-insert 74 and the under-surface 108 of the head 80. In the axial direction (note axis $A_A$), the distance between the first and second shoulders 96, 94 of the overcap 76 is less than the "height" of the gap 106. For example, there is a difference of 0.25±0.15 mm, as shown in FIG. 4C, between the gap height and the distance between the shoulders 94, 96.

The lower main surface 104 of the weight-insert 74 may also include an annular cutout 110, which is discussed later below. Briefly, the annular cutout 110 (which is made to a predetermined "depth" in the axial direction) provides controlled variability in the mass of the weight-insert 74 while preserving the same external look and threaded functionality when compared to other weight inserts within a kit or selection of same. The annular cutout 110 represents a corresponding volume of material removed from the weight-insert 74. This is a way in which the actual mass of a weight-insert 74 may be controllably reduced to provide the weight-insert with a desired mass, despite limitations that otherwise would be imposed by the weight-insert being made of a particular material having a particular respective density.

Figure 5A:
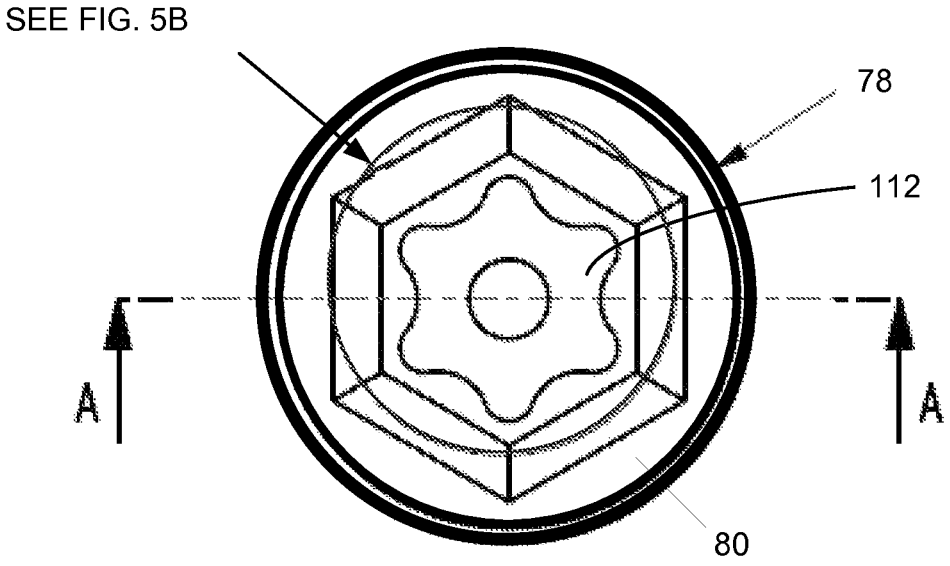
FIG. 5A is a top view of the drive-screw of the weight-assembly shown in FIG. 4A.
Figure 5B:
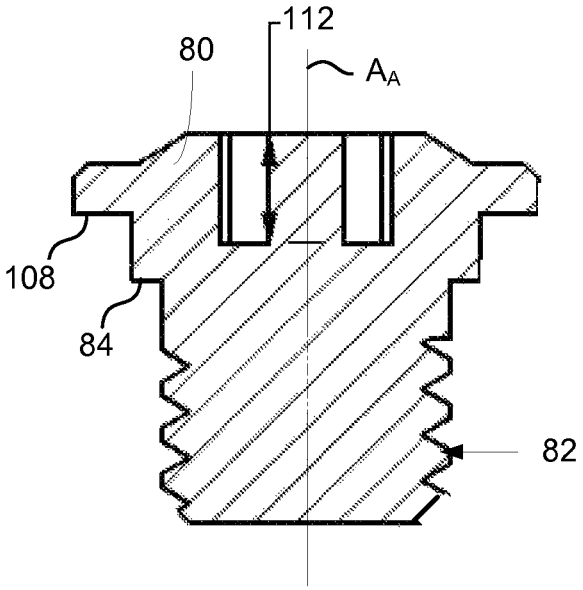
FIG. 5B is an elevational section of the drive-screw of FIG. 5A.

The drive-screw 78 of this embodiment is shown in more detail in FIGS. 5A and 5B, showing the head 80, the shoulder 84, and the male-threaded portion 82. The head 80 includes a suitable driver feature 112 (e.g., T20 Torx™ driver recess as shown in FIG. 5B). Although a Torx™ driver recess is desirable for aesthetic reasons, the driver feature 112 is not limited to a Torx-driver configuration and is not limited to driver recesses. Other possible driver features 112 include a hex-driver recess, a Phillips driver recess, or a flat-blade driver recess. Yet other possible driver features 112 include flats or the like that are engageable using a conventional wrench.

The drive-screw 78 can be made of any suitable rigid, durable material and serves, in cooperation with the overcap 76 and weight-insert 74, to provide an integral weight-assembly 72 having a desired mass. By way of example, the drive-screw 78 can be made of stainless steel or titanium alloy. Since these materials have different respective densities, they provide drive-screws 78 of similar size but different respective masses. This is desirable because the drive-screw 78 contributes a respective portion of the total mass of the weight-assembly 72 (wherein the weight-assembly 72 provides the desired swing-weight adjustment to the club).

Figure 6A:
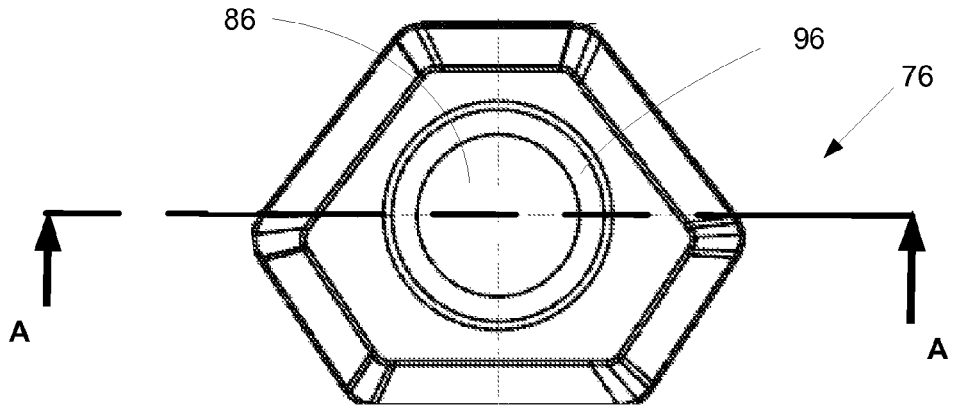
FIG. 6A is a top view of the overcap of the weight-assembly shown in FIG. 4A.
Figure 6B:
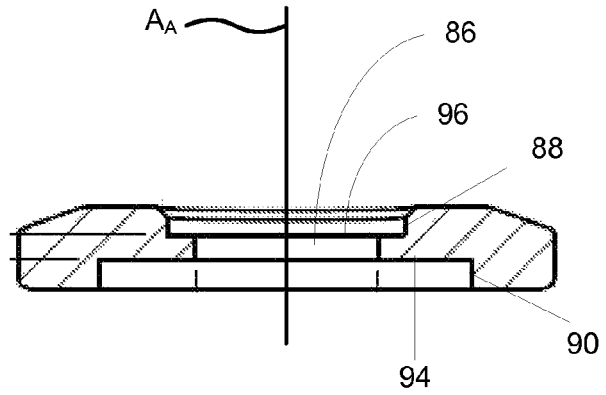
FIG. 6B is an elevational section of the overcap of FIG. 6A.

The overcap 76 of this embodiment, detailed in FIGS. 6A and 6B, has a nearly hexagonal outer profile that conforms to the profile of the cap-recess 62. As noted above, the overcap 76 freely rotates relative to the drive-screw 78 and the weight-insert 74 when the overcap 76 is not inserted into the cap-recess 62 (note the coincidence of the axes $A_A$ of the drive screw 78 and overcap 76 when assembled in this way). Although the profile of the depicted overcap 76 is nearly hexagonal, it differs sufficiently from being exactly hexagonal to ensure that the overcap fits into the cap-recess in only one orientation. Also shown in FIGS. 6A and 6B are the central aperture 86, the first and second counterbores 88, 90, and the first and second shoulders 96, 94, respectively.

The overcap 76 can be made of any suitable rigid, durable material such as, but not limited to, stainless steel, titanium (Ti) alloy, or tungsten (W) alloy. Overcaps 76 can be provided having various respective masses, depending upon the respective materials (particularly their respective densities) from which they are made. I.e., similar to the weight-insert 74, the mass of the overcap 76 is a function of its volume and of the density of the material from which it is made. The overcap 76 not only contributes a respective mass to the weight-assembly but also serves an aesthetic function. To the latter end, the overcap 76 can have a desired finish such as a polished finish, chromium plating, or physical-vapor-deposited (PVD) finish to achieve a similar appearance throughout the set of irons. In one embodiment, the overcap 76 has substantially the same geometry and volume throughout the entire set of irons to provide a consistent look and feel throughout the set. However, the overcap 76 may vary in density within a set.

The weight-insert 74 of this embodiment, detailed in FIGS. 7A-7D, can be made of any suitable rigid material of an appropriate density allowing the weight-insert to have a desired mass. The weight-insert 74 provides, in cooperation with the drive-screw 78 and overcap 76, a "weight-assembly" 72 contributing a desired amount of mass to the clubhead 50 for swing-weight adjustment purposes. (Note coincidence of the axes $A_A$ of the drive screw 78, overcap 76, and weight-insert 74 when assembled.)

Figure 7A:
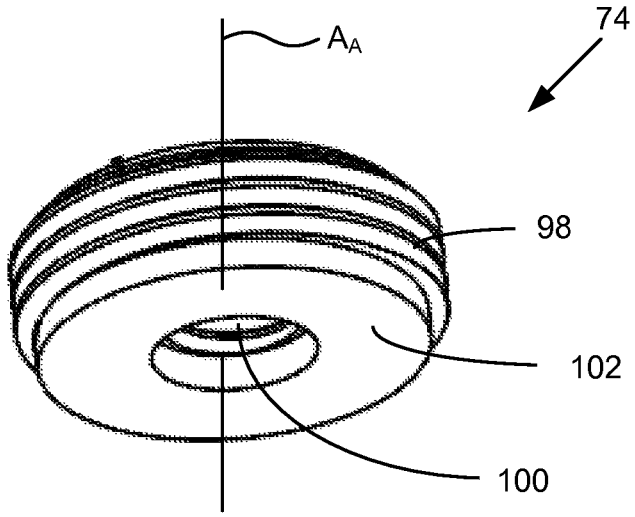
FIG. 7A is an oblique view of a weight-insert of the weight-assembly shown in FIG. 4A.
Figure 7B:
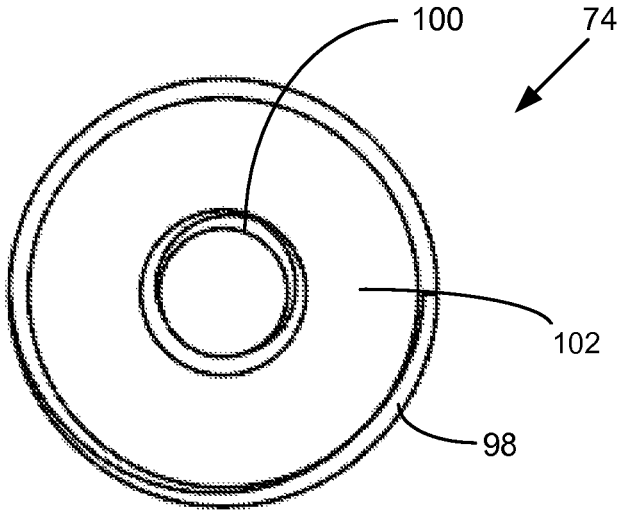
FIG. 7B is a plan view of the upper main surface of the weight-insert of FIG. 7A.
Figure 7C:
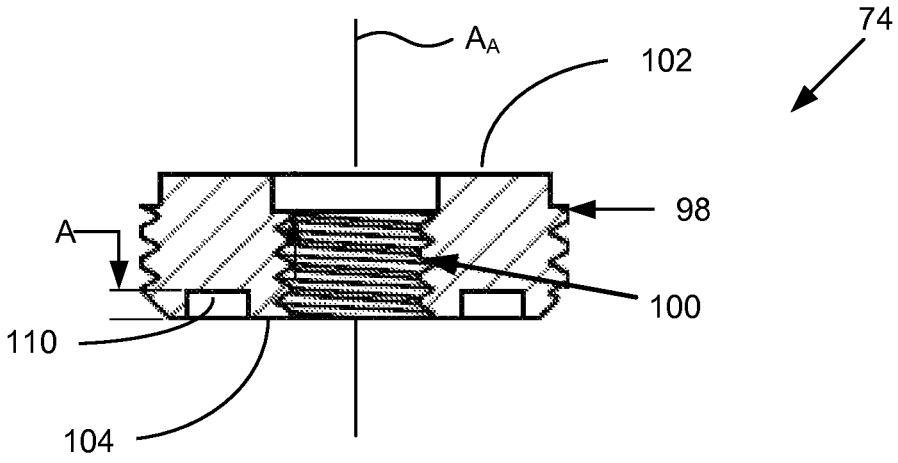
FIG. 7C is an elevational section of the weight-insert.
Figure 7D:
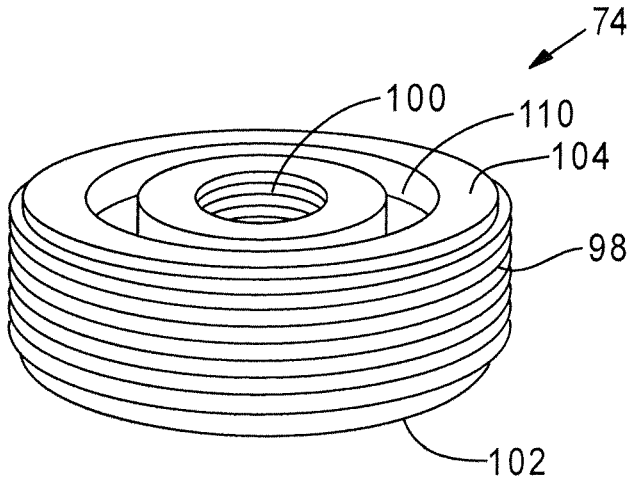
FIG. 7D is a perspective view of the lower main surface of the weight-insert of FIG. 7A.

As noted above, the weight-insert 74 can be made of any of various materials having respective densities. By selecting weight-inserts 74 from different materials, respective weight-assemblies 72 can be made up in which all the weight-inserts, overcaps 76, and drive-screws 78 have the same respective sizes and shapes but have different respective masses. Each weight-insert 74 also allows a selected amount of material to be removed from it for even greater selectivity of different masses thereof. Specifically, material is removed (as required) by cutting an annular cutout 110 (FIG. 7C) having a defined outer radius, a defined inner radius, and a defined depth "A". A perspective view of the weight-insert 74 is shown in FIG. 7D.

Figure 7E:
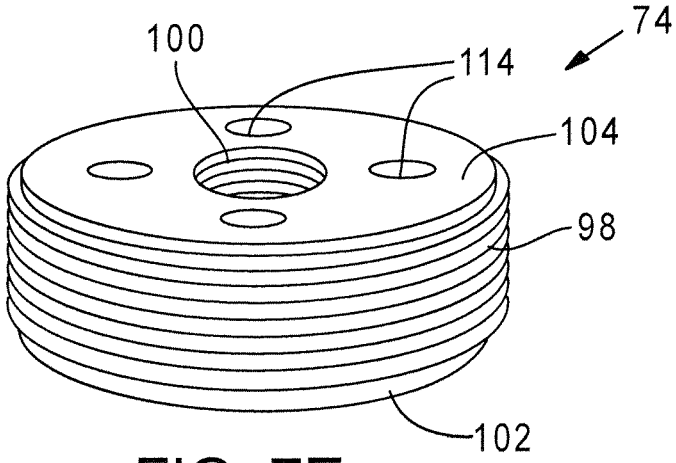
FIG. 7E is an oblique view of an alternative configuration of the weight-assembly shown in FIG. 4A.

As an alternative to the annular cutout, mass can be removed from the weight-insert 74 by any of various other cutouts, including but not limited to a circular array of holes 114 of defined depth. See FIG. 7E. The holes 114 or other cutout can be left empty or filled partially or fully with another material, such as a material that is denser than the material of the weight-insert 74, to provide even greater adjustability of the mass of the weight-insert.

To add a desired amount of adjustment mass to the clubhead 50 for, e.g., swing-weight-adjustment (SW-adjustment) purposes, a respective weight-assembly 72 is attached to the clubhead, as described below. Attachment of a weight-assembly 72 can be an initial attachment, such as at the time of manufacture of the golf club, or can be performed any time afterward. Hence, attachment of a weight-assembly 72 can be preceded by removal of an existing weight-assembly for replacement with a new one having a different mass. In such an instance, the mass of the new weight-assembly 72 can be greater than, equal to, or less than the mass of the previous one.

Each of the three parts of the weight-assembly 72 contributes a respective portion of the desired mass to be added to the clubhead 50 for SW-adjustment purposes. I.e., the total adjustment mass added to the clubhead 50 is the sum of the mass of the weight-insert 74, the mass of the overcap 76, and the mass of the drive-screw 78. By having respective mass contributions made by all three parts of the weight-assembly 72, fine adjustment-mass increments can be provided accurately using few parts.

Figure 8:
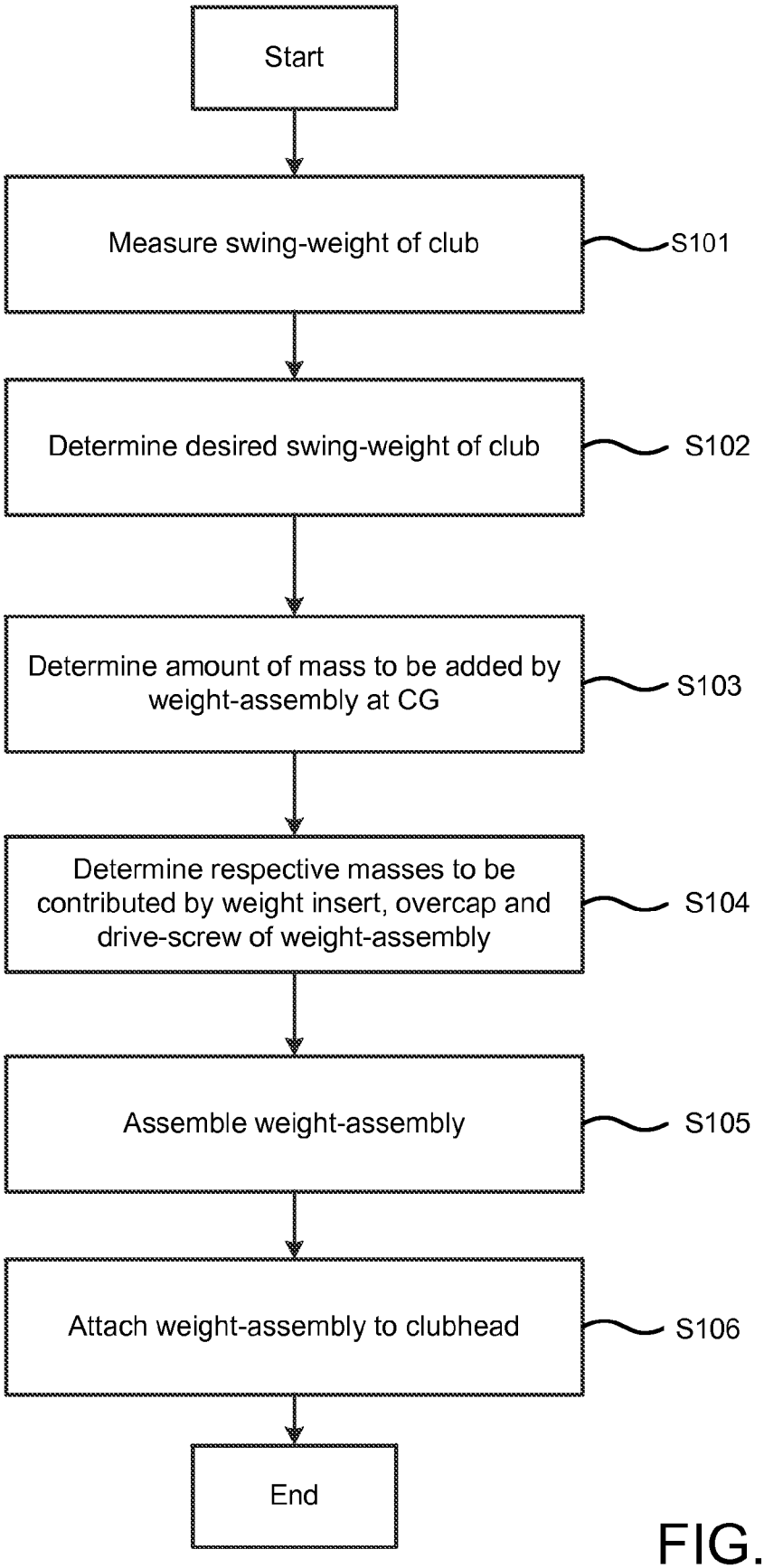
FIG. 8 is a flow-chart of a process for determining swing-weight of a golf club and, based on the determined swing-weight versus the desired swing-weight, attaching an appropriate weight-assembly to the club.

FIG. 8 is a flow-chart of a process for providing a golf club with a desired swing-weight. The process is assumed to be conducted with respect to a clubhead 50 configured to receive a swing-weight adjustment weight, such as a weight-assembly 72 as described above. In step S101, the initial swing-weight of the club is determined. This can be done accurately using a swing-weight-measuring device. In step S102 the desired swing-weight of the club is determined. The desired swing-weight will depend on various factors such as, but not limited to, the size, strength, golfing experience, and swing style of the golfer, the particularities of the club and clubhead, and other factors. The difference between initial swing-weight (step S101) and desired swing-weight (step S102) usually provides the determination made in step S103, which is of the particular mass to be added to or removed from the clubhead to provide it with the desired swing-weight. The process then assumes that the determination made in step S103 indicates a change in swing-weight is indicated. If a "kit" of weight-assemblies is at hand, this step may be performed simply by selecting the appropriate weight-assembly from the kit. Step S104 is performed as required, particularly if a weight-assembly having the desired mass is not immediately available. Step S104 may be conducted using a "kit" of weight-inserts 74, overcaps 76, and drive-screws 78 of different densities (and thus different respective masses). The kit may also include various weight-inserts 74 made of the same material (and thus having the same density) but having annular cutouts 110 at different depths. In any event, in step S104, a determination is made of the particular combination of weight-insert 74, overcap 76, and drive-screw 78 necessary to produce a weight-assembly 72 having the desired mass, wherein the desired mass is the sum of the respective masses of the selected weight-insert, overcap, and drive-screw. Upon making these selections, in step S105 the weight-insert 74, overcap 76, and drive-screw 78 are assembled together to produce the weight-assembly 72. In step S106 the weight-assembly 72 is attached to the clubhead 50 by threading the weight-insert into the weight-mounting aperture 60 on the clubhead. This threading is facilitated using a drive tool that engages with the particular driver feature 112 in or on the head 80 of the drive-screw 78.

By fabricating weight-inserts 74 of different materials having different respective masses and different respective amounts of material removed from the annular cutouts 110 thereof (which can be zero material removed, in which event the weight-insert lacks an annular cutout), by fabricating drive-screws 78 of different respective masses, and by fabricating overcaps 76 having different respective masses, an assortment ("kit") of these components is provided for making up a wide variety of weight-assemblies that are identically sized but have different respective masses for mounting to the clubhead 50 to achieve respective desired SW adjustments. Table 2, below, lists an exemplary range of such "assembled weights" (total mass of weight-assembly 72). With respect to the weight-inserts 74, the respective depths of the annular cutout 110 (if present, see FIG. 7(C)) are also listed ("A"). In the table, 27 weight-assemblies are listed each having a different respective total mass ("assembled weight") in the range of 4 to 17 grams, in 0.5-gram increments. For example, if an assembled weight of 14.5 g is desired, the respective weight-assembly can be made up of a weight-insert having a mass of 7.26 g, a density of 14.5 g/cm$^3$, and a cutout depth A=1.2 mm; a drive-screw made of 6-4 Ti and having a mass of 0.66 g; and an overcap made of tungsten and having a mass of 6.69 g.

TABLE 2

| Assemb'd Wt | Tol. | Insert Wt (±0.05) | Insert Dens. | A (mm) | Screw Mat'l | Screw Wt (g) | Over-Cap | OC Wt (g) |
|---|---|---|---|---|---|---|---|---|
| 17 g | ±0.3 g | 9.76 g | 17.0 | 0 | Ti 6-4 | 0.66 | W | 6.69 |
| 16.5 g | ±0.3 g | 9.26 g | 17.0 | 0.42 | Ti 6-4 | 0.66 | W | 6.69 |
| 16 g | ±0.3 g | 8.76 g | 17.0 | 0.95 | Ti 6-4 | 0.66 | W | 6.69 |
| 15.5 g | ±0.3 g | 8.26 g | 14.5 | 0 | Ti 6-4 | 0.66 | W | 6.69 |
| 15 g | ±0.3 g | 7.76 g | 14.5 | 0.6 | Ti 6-4 | 0.66 | W | 6.69 |
| 14.5 g | ±0.3 g | 7.26 g | 14.5 | 1.2 | Ti 6-4 | 0.66 | W | 6.69 |
| 14 g | ±0.3 g | 9.76 g | 17.0 | 0 | 17-4 SS | 1.14 | 17-4 SS | 3.07 |
| 13.5 g | ±0.3 g | 9.76 g | 17.0 | 0 | Ti 6-4 | 0.66 | 17-4 SS | 3.07 |
| 13 g | ±0.3 g | 9.26 g | 17.0 | 0.42 | Ti 6-4 | 0.66 | 17-4 SS | 3.07 |
| 12.5 g | ±0.3 g | 8.76 g | 17.0 | 0.95 | Ti 6-4 | 0.66 | 17-4 SS | 3.07 |
| 12 g | ±0.3 g | 8.26 g | 14.5 | 0 | Ti 6-4 | 0.66 | 17-4 SS | 3.07 |
| 11.5 g | ±0.3 g | 7.76 g | 14.5 | 0.6 | Ti 6-4 | 0.66 | 17-4 SS | 3.07 |
| 11 g | ±0.3 g | 7.26 g | 14.5 | 1.2 | Ti 6-4 | 0.66 | 17-4 SS | 3.07 |
| 10.5 g | ±0.3 g | 6.76 g | 14.5 | 1.8 | Ti 6-4 | 0.66 | 17-4 SS | 3.07 |
| 10 g | ±0.3 g | 6.26 g | 11.0 | 0 | Ti 6-4 | 0.66 | 17-4 SS | 3.07 |
| 9.5 g | ±0.3 g | 5.76 g | 11.0 | 0.8 | Ti 6-4 | 0.66 | 17-4 SS | 3.07 |
| 9 g | ±0.3 g | 5.26 g | 11.0 | 1.6 | Ti 6-4 | 0.66 | 17-4 SS | 3.07 |
| 8.5 g | ±0.3 g | 4.76 g | 11.0 | 2.4 | Ti 6-4 | 0.66 | 17-4 SS | 3.07 |
| 8 g | ±0.2 g | 4.26 g | 7.8 | 0.4 | Ti 6-4 | 0.66 | 17-4 SS | 3.07 |
| 7.5 g | ±0.2 g | 3.76 g | 7.8 | 1.5 | Ti 6-4 | 0.66 | 17-4 SS | 3.07 |
| 7 g | ±0.2 g | 3.26 g | 7.8 | 2.65 | Ti 6-4 | 0.66 | 17-4 SS | 3.07 |
| 6.5 g | ±0.2 g | 2.76 g | 7.8 | 3.8 | Ti 6-4 | 0.66 | 17-4 SS | 3.07 |
| 6 g | ±0.2 g | 2.26 g | 4.5 | 1.17 | Ti 6-4 | 0.66 | 17-4 SS | 3.07 |
| 5.5 g | ±0.2 g | 1.76 g | 4.5 | 3.2 | Ti 6-4 | 0.66 | 17-4 SS | 3.07 |
| 5 g | ±0.2 g | 1.26 g | 2.7 | 1.8 | Ti 6-4 | 0.66 | 17-4 SS | 3.07 |
| 4.5 g | ±0.2 g | 2.03 g | 4.5 | 2.1 | Ti 6-4 | 0.66 | Ti 6-4 | 1.77 |
| 4 g | ±0.2 g | 1.53 g | 2.7 | 0 | Ti 6-4 | 0.66 | Ti 6-4 | 1.77 |

In Table 2, "Ti 6-4" is the 6-4 alloy of titanium, "SS" is stainless steel, and "W" is tungsten. "Dens." is density in g/cm$^3$. It will be understood that the values listed in Table 2 are by way of example, and are not intended to be limiting in any way.

Figure 9:
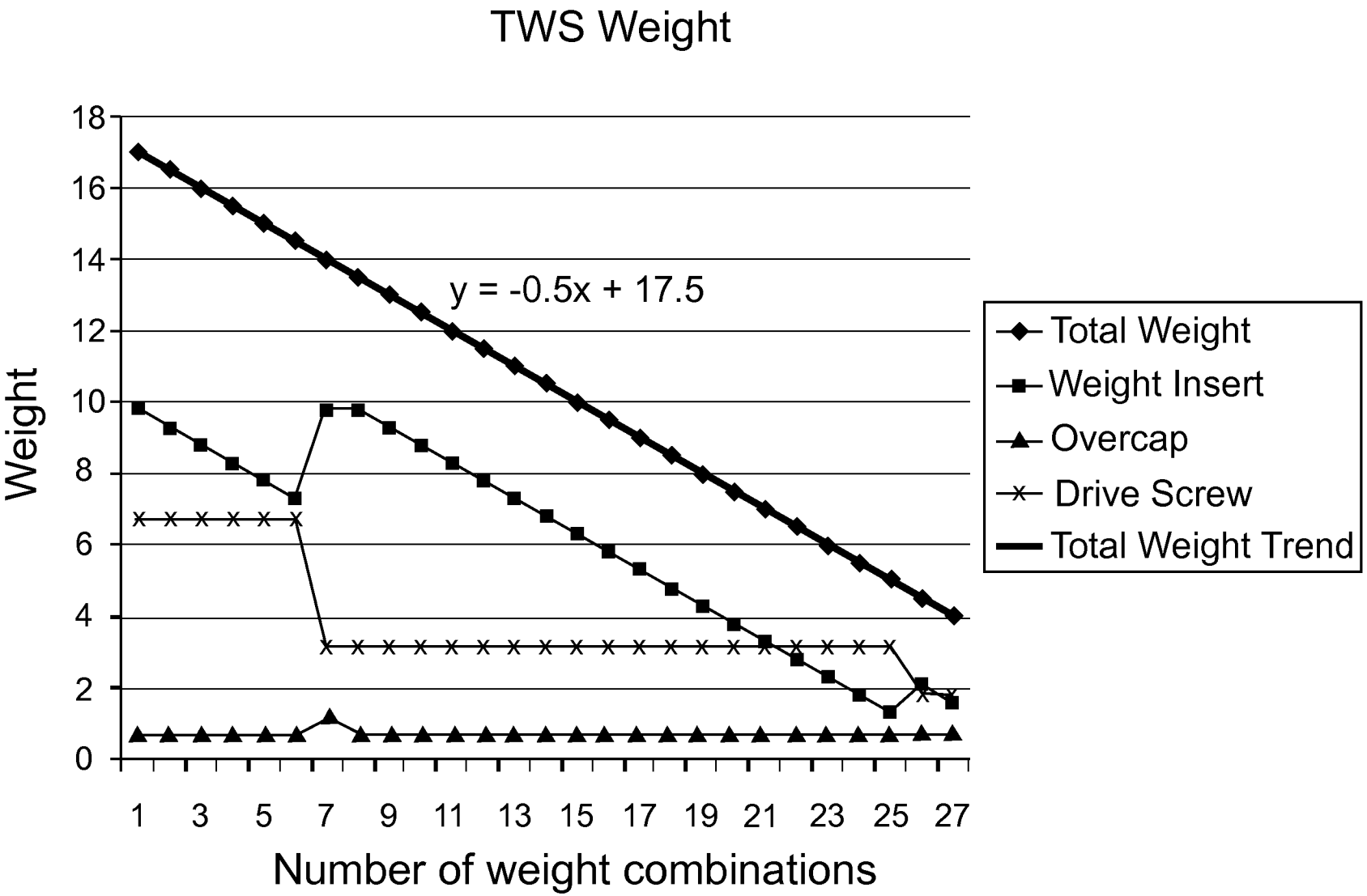
FIG. 9 is a plot of the data shown in Table 2.

The data in Table 2 are plotted in FIG. 9. The first column in Table 2, i.e., total weight, is the ordinate, ranging from 0 g (no weight-assembly attached to the clubhead) to 18 g (heaviest weight-assembly attached to the clubhead). This range encompasses the actual range, 4 g to 17 g, in Table 2. In FIG. 9 the abscissa is "combination number", which simply is row number in Table 2, ranging from "1" (first row in Table 2) to "17" (last row in Table 2). Each of these "combinations" has a respective weight-assembly mass ("total weight" in Table 2) produced by respective contributions from the weight-insert, the drive-screw, and the overcap. I.e., FIG. 9 is a plot of the mass contributions from the weight-insert, the drive-screw, and the overcap to the respective total mass of each combination. In FIG. 9 the data plotted as diamond-shaped points (◆) are respective total mass for each combination. The data plotted as square points (■) are the respective mass contributions made by the weight-insert 74. The data plotted as "x" points are the respective mass contributions made by the overcap 76, and the data plotted as triangles (▲) are the respective mass contributions made by the drive-screw 78. Also included are respective linear best-fit lines for each plot.

The ◆-◆-◆ plot is substantially linear because Applicants have discovered that it is possible to provide a consistent mass increment (in this case, about 0.5 g) between each successive pair of points in this plot. The slope of the total-mass-combination plot ◆-◆-◆, seen in FIG. 9, can be between 0.2 and 1, or about 0.5. The ◆-◆-◆ plot is the sum of the ■-■-■, x-x-x, and ▲-▲-▲ plots. Each of the ■-■-■, x-x-x, and ▲-▲-▲ plots theoretically could be linear. But, from a practical standpoint: (a) the respective volumes of the weight-insert 74, overcap 76, and drive-screw 78 are constant (except for small variations achieved by different respective depths of "A" on the weight-insert), (b) the number of materials (and thus densities) available for making these components is not unlimited, and (c) each of the combinations 1-27 represents a respective combination of mass contributions from these three components fabricated from the particular materials noted in Table 2. Consequently, the ■-■-■, x-x-x, and ▲-▲-▲ plots are not linear from a practical standpoint. Under actual manufacturing situations, at least one of these plots will be non-linear. In some embodiments, at least two of the weight components have a non-linear plot profile when plotted in relation to the total-weight-assembly trend line that is linearly decreasing. In one example, at least one of the weight components actually increases in weight as the total weight assembly decreases in weight in going from a first total weight to a second total weight.

Note that an extremely wide range of weight-assembly masses is provided, with consistent 0.5-g increments consistently therebetween. This range, due in part to the weight-assembly being made of three components each having a respective variable density and to the extremely accurate manner by which mass can be trimmed from one of the components (weight-insert) by forming cutouts of selected depths, is a testament to this system's high level of flexibility compared to conventional systems. The 0.5-gram increment of successive combinations 1-27 is not intended to be limiting. For example, in view of the present showing that a large number of combinations can be obtained with increments of 0.5 g between each successive pair of combinations by using a small number of materials, it is readily understood that smaller increments can also be obtained, if desired, by using a slightly greater number of materials than used to produce the increments of 0.5 g. It is also readily understood that a set of combinations with larger increments between them can be readily provided as well. The set of combinations with 0.5-gram increments has sufficient mass resolution to handle the vast majority of SW-adjustments that would normally be encountered.

As noted above, the weight-assembly 72 is mounted on the rear of the clubhead 50. This manner of mounting places the mass of the weight-assembly as close as possible to the CG of the clubhead 50, at least in the X- and Z-directions. (The Y-direction for golf clubs is front-to-back, and by centering the weight-mounting aperture 60 as closely as possible on the Y-axis, no significant change is made to the Y-coordinate of the CG whenever the weight-assembly is added, changed, or removed.) This manner of mounting also concentrates the added mass in the region of the CG. Consequently, adding or changing the SW-adjustment mass can be performed (by adding or changing the weight-assembly 72) without substantially changing the location of the club's CG. Also, adding or changing the SW-adjustment mass can be performed easily and quickly using a single tool and without having to disassemble, damage, or destroy the clubhead itself. The range of SW-adjustment mass that can be added to the clubhead 50 is limited largely by the respective densities of available materials used for fabricating the weight-insert 74, overcap 76, and mounting-screw 78. The incremental difference in total mass from one weight-assembly 72 to another (see Table 2) is also limited by the range of available materials and by the depth dimension of the weight-receiving cavity. In certain embodiments, the bottom surface of the weight-insert 74 does not touch the bottom surface of the weight-receiving cavity. In other words, in these embodiments the weight-insert 74 does not "bottom out" in the weight-receiving cavity, which ensures a consistent frictional force capable of preventing the weight-insert 74 from becoming loose. In situations in which the weight-insert 74 does bottom out, the weight-insert 74 will be more likely to become undesirably loose during use. Thus, a gap is present between the bottom surface 104 of the weight-insert 74 and a bottom surface of the weight-insert cavity 60. In addition, a higher tension force created in the threaded engagement of the weight-insert 74 allows for the use of a non-circular, irregular, or polygonal overcap 76 geometry. In general, a non-circular overcap 76 geometry is more difficult to keep in tension than a circular overcap geometry since the circular geometry may distribute tension forces more evenly. Therefore, the non-circular overcap 76 geometry requires a weight-insert 74 that is not "bottomed out" in order to maintain sufficient threaded engagement between the weight-insert 74 and the weight-insert-cavity threads 70 during use.

It will be understood that a golf club according to this embodiment, having a weight-mounting aperture 60 and cap-recess 62, need not have a weight-assembly 72 attached to it. The weight-assembly 72 is attached to the club on an as-needed basis.

It will also be understood that a given set of golf clubs all provided with respective weight-assemblies 72 will not necessarily have the same added mass. As discussed above, every component of a clubhead has its own respective manufacturing tolerance, and these tolerances (including mass tolerances) normally do not add up identically with each club produced on a production line. For example, the cumulative mass tolerance of clubheads in a set coming off an assembly line can be ±3%, which can have a significant impact on the swing-weight of each club in the set. The weight-assemblies disclosed herein provide an advantageous way of readily tuning each club in a set, or each club in a production lot, to have a desired swing-weight. This can be done by simply placing the club on a SW-measuring scale, selecting a weight-assembly having an appropriate mass to provide the club with the desired swing-weight, then attaching the weight-assembly to the club.

A golf club's swing-weight as established at time of manufacture can be changed later at, for example, point of sale at which time a set of clubs is being configured for a particular buyer. The club's swing-weight can also be changed after sale, for example, to accommodate the results of the owner's progress to more accomplished play, or to re-establish a nominal swing-weight after making a change in a club such as changing the size of the grip. The golfer may elect, after using the clubs for awhile, to change the swing-weight on certain clubs and not others; thus, all the clubs in the golfer's set may deliberately not have the same swing-weight.

A set or kit of drive-screws 78, weight-inserts 74, and overcaps 76 of various respective masses, (or a kit of pre-assembled weight-assemblies 72) will normally be available on the manufacturing floor where clubheads and clubs according to this embodiment are being produced. Similar sets or kits may also be provided to, for example, "pro-shop" merchants, golf-instruction professionals, and/or "tour vans" for use in customizing clubs, according to this embodiment, for a particular player.

It is also contemplated that individual golfers may be provided with kits of weight-inserts 74, overcaps 76, and drive-screws 78 (and/or kits of pre-assembled weight-assemblies 72) to provide the golfer with "on-demand" adjustability of swing-weight, at least within a limited range flanking the nominal swing-weight suitable for the golfer. As the golfer gains experience with the SW-adjustability thus provided to him or her, the golfer may develop a ready sense of particular swing-weight values to be imparted to his or her clubs to meet prevailing play conditions. A golfer on a tournament circuit could have a kit on his or her tour van.

Second Representative Embodiment

This embodiment is directed to a "muscle back" iron clubhead and club including an SW-adjustment weight-assembly. This embodiment is substantially similar to the first representative embodiment, except for the specific configuration of the clubhead (muscle back versus cavity back). Components and other features of this embodiment that are similar to corresponding components and features of the first representative embodiment are not discussed below in detail.

Figure 10A:
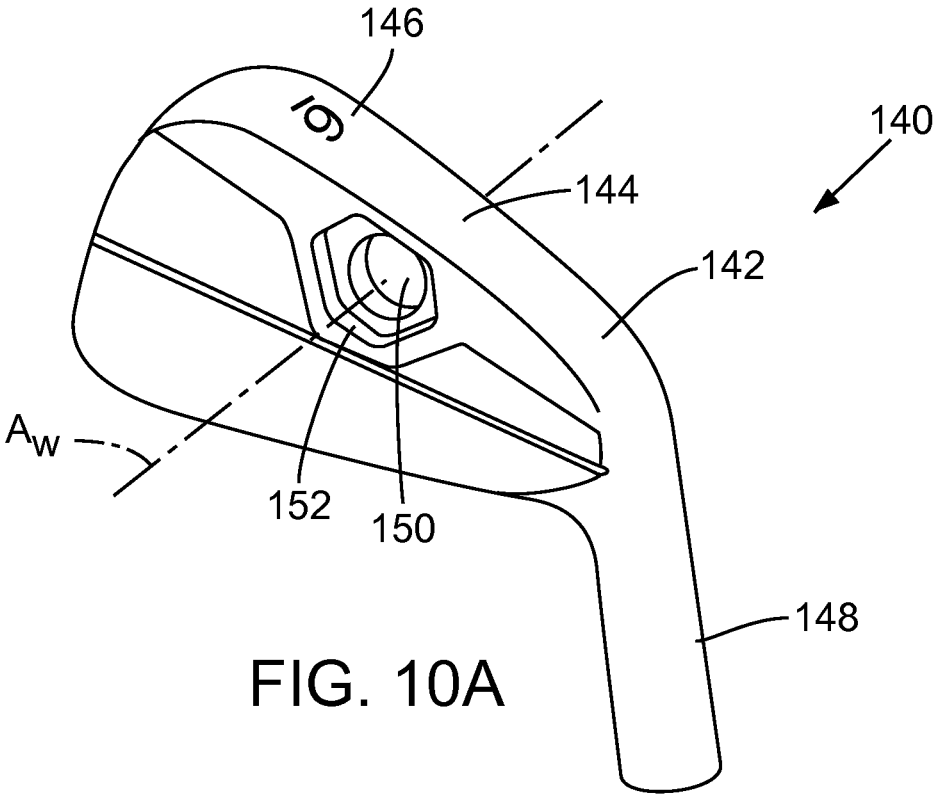
FIG. 10A is an oblique view of a muscle-back iron-type clubhead according to the second representative embodiment; this view depicts the weight-mounting aperture and cap-recess that receive a weight-assembly.

A general oblique view of the clubhead 140 is shown in FIG. 10A, in which the heel 142, sole 144, toe 146, and hosel 148 are visible. Also visible are a weight-mounting aperture 150 and a cap-recess 152 by which a weight-assembly 72 for providing the desired mass adjustment is attached to the clubhead 140. The aperture 150 and cap-recess 152 share an axis A.

Figure 10B:
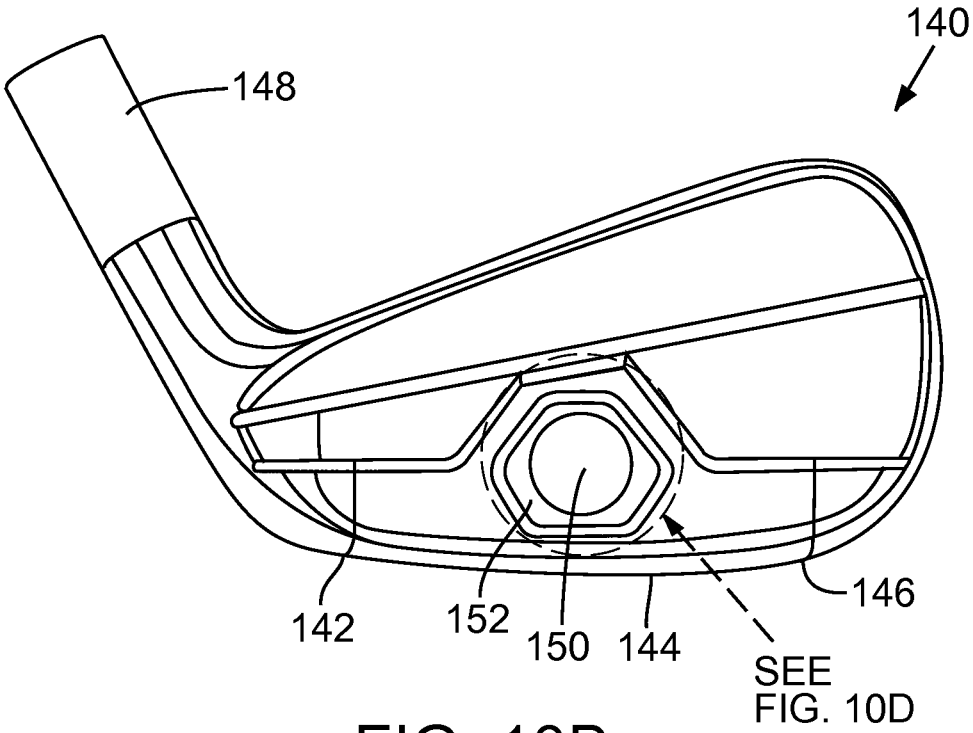
FIG. 10B is an elevational view of the rear of the clubhead of FIG. 10A.
Figure 10C:
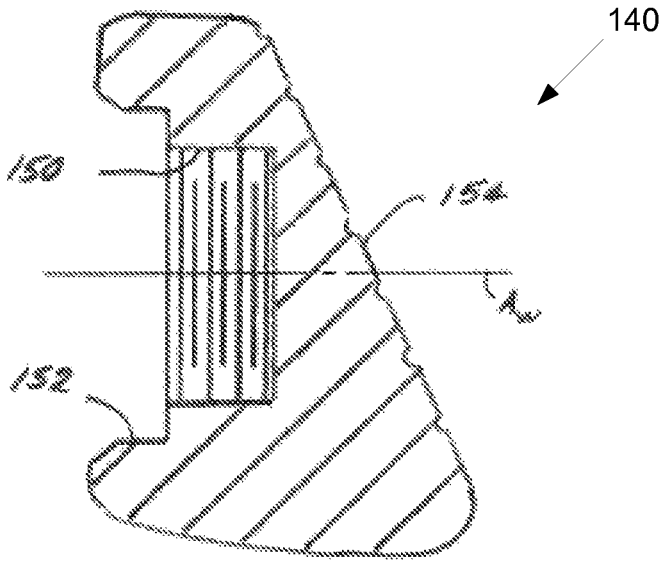
FIG. 10C is a transverse section of the clubhead of FIG. 10A.
Figure 10D:
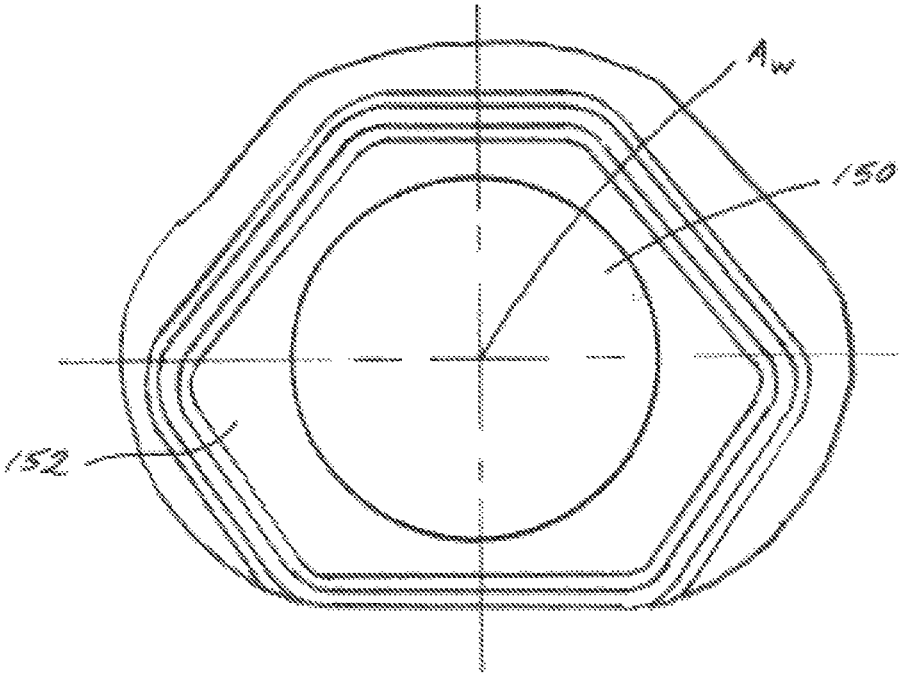
FIG. 10D is an enlargement of the region of FIG. 10B located within the circle.

The weight-assembly 72 used with this clubhead is essentially the same as used in the first representative embodiment, and comprises a weight-insert 74, an overcap 76, and a drive-screw 78. FIG. 10B is an elevational view of the rear of the clubhead, showing the female-threaded weight-mounting aperture 150 and the cap-recess 152. FIG. 10C is an elevational section showing the strike face 154, weight-mounting aperture 150, and cap-recess 152. FIG. 10D is a detailed face view of the cap-recess 152.

EXAMPLE

As discussed above, certain conventional golf clubs include a hosel "plug" inserted in the hosel to increase the swing-weight of the club. Adding weight in this manner will affect the mass properties of the clubhead, which can result in a substantial change in the location of the center of gravity (CG) of the clubhead. As can be imagined, a conventional clubhead including 1 g of additional weight will have a different weight distribution than a conventional clubhead including 10 g of additional weight.

This example is a comparison of the CG shift exhibited by a golf club according to the second representative embodiment to which a 5-g weight-assembly or a 10-g weight-assembly has been attached, compared to the CG shift exhibited by a conventional golf club to which a 5-g or 10-g hosel plug has been attached. The results obtained are tabulated in Table 3, below. In the table, "CGX" denotes heel-to-toe position of the CG, and "Zup" denotes the vertical position of the CG resulting from adding the respective mass to the clubhead. "Nom." denotes nominal CGX or Zup, with zero mass added to the clubhead. Regarding added mass, "5-g" and "10 g" denote 5 and 10 grams of added mass, respectively. Clubheads A and B are muscle-back iron-type clubheads to which conventional 5-g and 10-g hosel plugs are attached, and clubheads C and D are corresponding muscle-back iron-type clubheads according to this embodiment.

TABLE 3

| Clubhead | Nom. CGX | 5 g CGX | 10 g CGX | CG Shift* | Nom. Zup | 5 g Zup | 10 g Zup | Zup Shift* |
|---|---|---|---|---|---|---|---|---|
| Conv. A | 1.7 | 2.6 | 3.5 | 1.8 | 19.6 | 19.8 | 20.1 | 0.5 |
| Conv. B | 3.3 | 4.1 | 4.9 | 1.6 | 19.2 | 19.4 | 19.5 | 0.3 |
| Emb. C | 1.7 | 1.6 | 1.6 | −0.1 | 19.6 | 19.5 | 19.4 | −0.2 |
| Emb. D | 3.3 | 3.2 | 3.2 | −0.1 | 19.2 | 19.0 | 18.9 | −0.3 |

In Table 3, the data for clubheads "Cony. A" and "Cony. B" are as also listed in Table 1. In Table 3, "CG Shift*" and "Zup Shift*" are respective shifts obtained with 10 g of added mass, as in Table 1.

Table 3 shows that clubheads C and D according to this embodiment exhibited substantially less shift of CG and Zup upon the addition of a 5-g or 10-g weight-assembly, in contrast to the conventional clubheads A and B. Specifically, in this example the CG moved no more than 0.3 mm in any direction as the swing-weight was manipulated by as much as 10 g using respective weight-assemblies. The CG shift resulting from 10 g of added mass, compared to the initial CG position, is shown in FIG. 2B. Compare FIG. 2B to FIG. 2A, the latter depicting the CG shift exhibited by a clubhead to which conventional hosel plugs have been attached. The improvement shown in FIG. 2B is substantial. Thus, key advantages of this and other embodiments are flexibility, simplicity, and accuracy with which swing-weight changes can be made, especially while avoiding undesired collateral changes in the club such as a significant change in CG position. These swing-weight changes can be achieved easily and quickly, without damaging or having to disassemble the clubhead from the shaft.

Third Representative Embodiment

Figure 11:
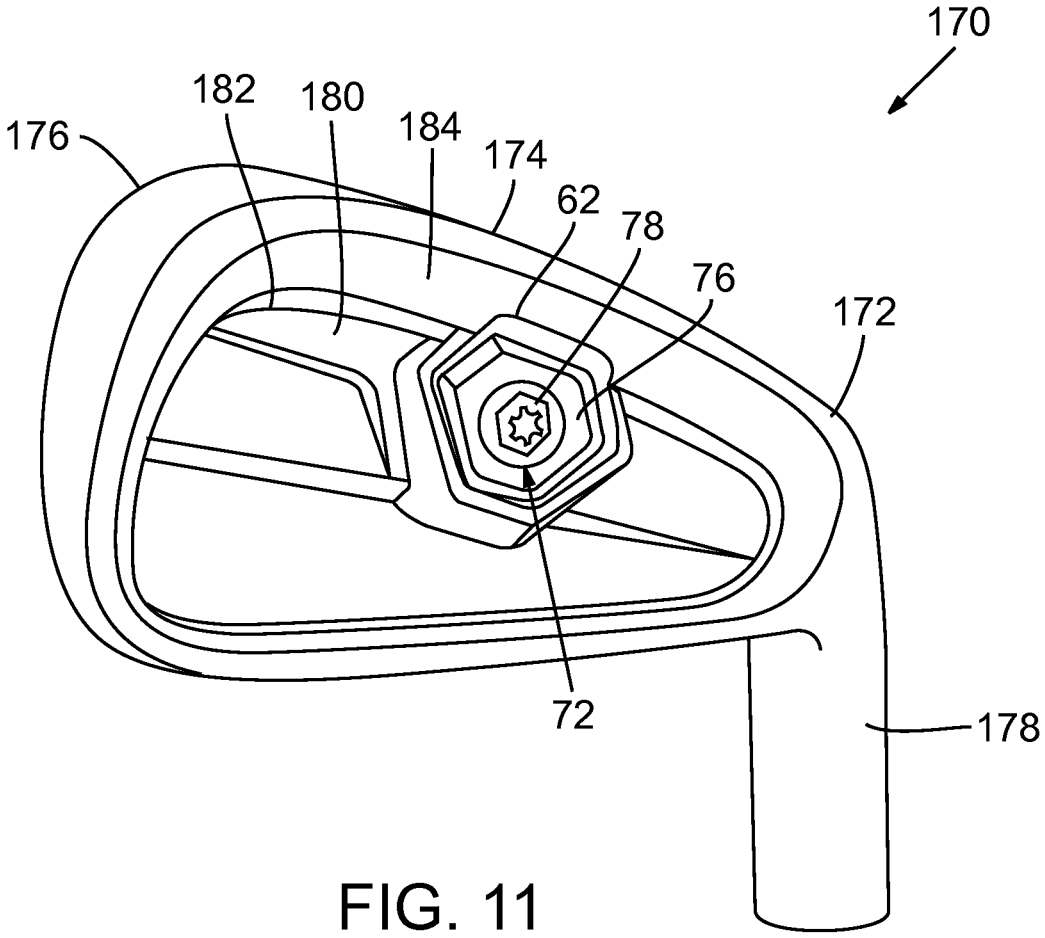
FIG. 11 is an oblique view of an iron-type clubhead according to the third representative embodiment.

This embodiment is directed to an "MC" iron clubhead 170 and club including a weight-assembly 72 providing a desired swing-weight. A general oblique view of the clubhead 170 is shown in FIG. 11, in which the heel 172, sole 174, toe 176, and hosel 178 are visible. Also visible is a weight-assembly 72 mounted to the clubhead. The weight-assembly 72 is similar to corresponding weight-assemblies used in the first and second representative embodiments. The weight-assembly 72 comprises a weight-insert 74 (not visible in the figure), an overcap 76, and a drive-screw 78. To mount the weight-assembly 72 to the clubhead 170 the weight-insert 74 is threaded into the weight-mounting aperture 60 (not visible), as the overcap 76 is fitted into the corresponding cap-recess 62. Assembling the weight-assembly 72 to the clubhead 170 is performed entirely by turning the drive-screw 78, hence the name "drive"-screw. Thus, the weight-assembly 72 for providing the desired mass adjustment is attached to the clubhead 170.

The weight-mounting aperture 60 and cap-recess 62 are defined in a relatively thick portion 184 of the clubhead 170 extending along the sole 174 from heel 172 to toe 176. At about mid-length the thick portion breaks from its linearity to extend around the cap-recess 62.

Also visible in FIG. 11 is a "cavity badge" 180 that is fitted into a respective badge-recess 182 defined in the rear surface of the clubhead 170. In this embodiment the cavity badge 180 fits around the thick portion 184 in which the cap-recess is defined.

Fourth Representative Embodiment

Figure 12:
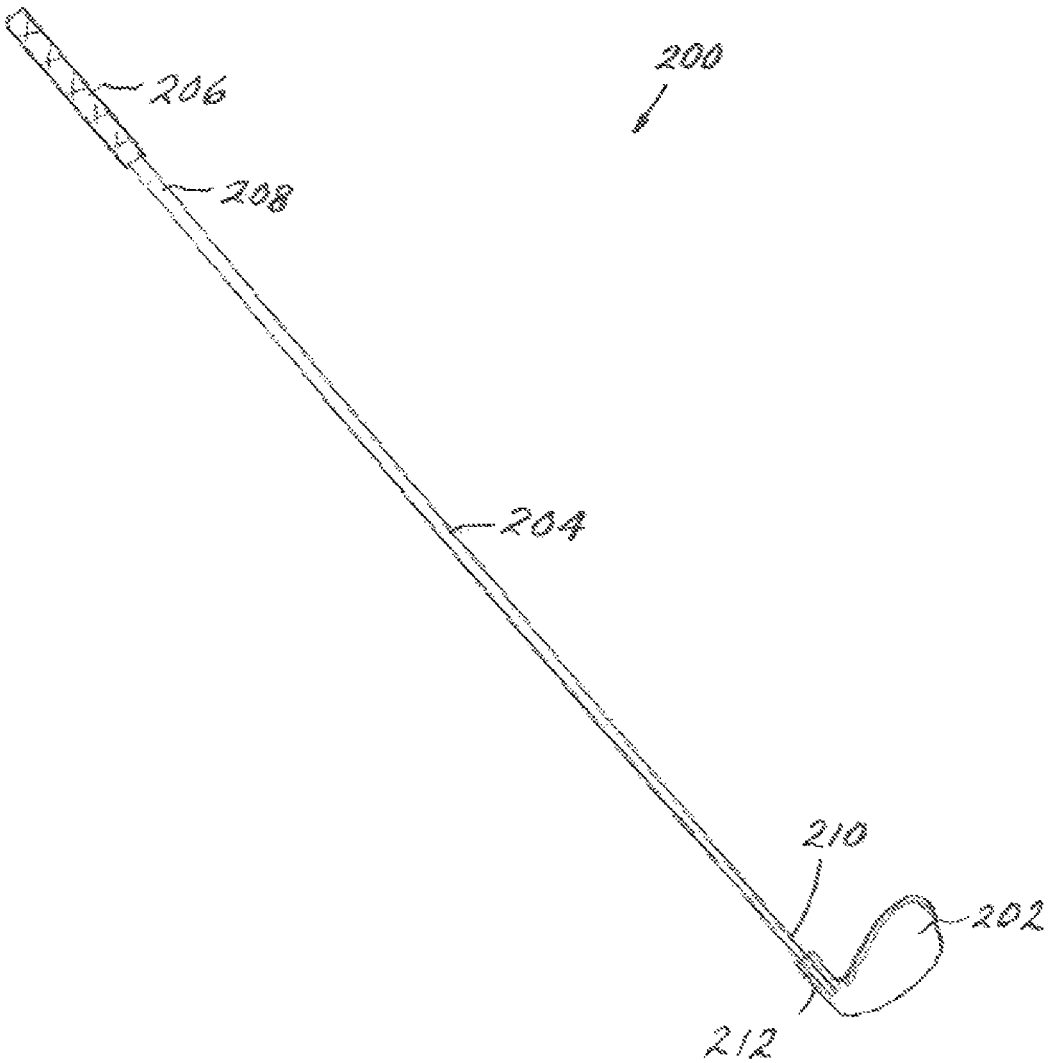
FIG. 12 is an oblique view of a golf club according to the fourth representative embodiment.

This embodiment is directed to a golf club 200 comprising a clubhead 202 (including weight-assembly, not detailed) as described in any of the foregoing embodiments. Reference is made to FIG. 12, in which the golf club 200 comprises, in addition to the clubhead 202, a shaft 204, and a grip 206 fitted to the upper (thicker) end 208 of the shaft. The distal (thinner) end 210 of the shaft 204 fits into the hosel 212 of the clubhead 202.

Although the clubhead is depicted in FIG. 12 as an iron-type clubhead, it is not limited to an iron-type clubhead. For example, the clubhead (including weight-assembly) can be any of various other clubheads not normally included in the "iron" category such as sand wedges and putters. In general, the clubhead can be any type that allows the weight-assembly, when mounted to the clubhead, to impart no greater than 0.3 mm or 0.2 mm shift to the CG in the vertical (Z) direction and no greater than 1.7 mm, 1.6 mm, 1.5 mm, or 1 mm shift of the CG in the X-direction in comparison to the CG location of the nominal clubhead. In one embodiment, the CG shift is no more than 1.7 mm, 1.6 mm, 1.5 mm, 1 mm, or 0.5 mm in an absolute distance (i.e., linear distance between two CG points) between a nominal CG location and a CG location after a weight is inserted into the clubhead.

Whereas the invention has been described in connection with representative embodiments, it will be understood that it is not limited to those embodiments. On the contrary, it is intended to encompass all alternatives, modifications, and equivalents as may be included within the spirit and scope of the invention as defined by the appended claims.

What is claimed is:

1. A golf club comprising:

a clubhead comprising a body having a front and a rear, the front including a strike face, the rear including a weight-receiving cavity, and the body having a center of gravity (CG) having respective X-, Y-, and Z-coordinates;

a shaft connected to the clubhead, thereby forming the golf club having a nominal swing-weight;

a weight-assembly removably attached as a unit to the weight-receiving cavity, the weight-assembly having a corresponding assembled total mass providing a corresponding swing-weight (SW) contribution to the club, the weight-assembly comprising at least a first portion, a second portion, and a third portion each contributing a respective mass portion to the assembled total mass of the weight-assembly and thus to the SW contribution made by the weight-assembly to the club, wherein the total mass of the weight-assembly linearly displaces the CG location no more than 1.7 mm with the weight-assembly attached to the body compared to a CG location of the clubhead when the weight-assembly is not attached to the body;

the third portion of the weight-assembly is a drive-screw that threads into the first portion;

the first portion threads into the weight-receiving cavity; and the second portion of the weight-assembly comprises a non-circular overcap held to the first portion by the third portion whenever the first portion is threaded into the weight-receiving cavity.

2. The golf club of claim 1, wherein;

the first portion is a weight-insert;

the second portion is an overcap that extends over and conceals the weight-insert whenever the weight-assembly is attached to the weight-receiving cavity; and the weight-insert and drive-screw freely rotate relative to the overcap.

3. The golf club of claim 1, wherein the weight-insert defines at least one cutout having a defined volume that subtracts a respective portion of mass from the weight-insert compared to an otherwise similar weight-insert lacking the at least one cutout.

* * * * *

UNITED STATES PATENT AND TRADEMARK OFFICE

CERTIFICATE OF CORRECTION

PATENT NO. : 8,550,933 B2
APPLICATION NO. : 13/194846
DATED : October 8, 2013
INVENTOR(S) : Demkowski et al.

It is certified that error appears in the above-identified patent and that said Letters Patent is hereby corrected as shown below:

In the Specification:

Column 18, line 21, ""Cony. A" and "Cony. B"" should read --""Conv. A" and Conv. B""--

Signed and Sealed this
Second Day of September, 2014

Michelle K. Lee

Michelle K. Lee
*Deputy Director of the United States Patent and Trademark Office*